US010516951B2

(12) United States Patent
Wenzel

(10) Patent No.: US 10,516,951 B2
(45) **Date of Patent: *Dec. 24, 2019**

(54) ADJUSTABLE VENTING FOR HEARING INSTRUMENTS

(71) Applicant: EarLens Corporation, Menlo Park, CA (US)

(72) Inventor: Stuart W. Wenzel, San Carlos, CA (US)

(73) Assignee: Earlens Corporation, Menlo Park, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/718,398

(22) Filed: Sep. 28, 2017

(65) Prior Publication Data

US 2018/0020296 A1 Jan. 18, 2018

Related U.S. Application Data

(63) Continuation of application No. 14/554,606, filed on Nov. 26, 2014, now Pat. No. 9,924,276.

(51) Int. Cl.
*H04R 25/00* (2006.01)

(52) U.S. Cl.
CPC ..... *H04R 25/456* (2013.01); *H04R 2460/09* (2013.01); *H04R 2460/11* (2013.01)

(58) Field of Classification Search
CPC .. H04R 25/456; H04R 2460/09; H04R 25/48; H04R 1/24; H04R 11/02; H04R 25/502; H04R 25/604
See application file for complete search history.

(56) References Cited

U.S. PATENT DOCUMENTS

| | | | |
|---|---|---|---|
| 2,763,334 | A | 9/1956 | Starkey |
| 3,209,082 | A | 9/1965 | McCarrell et al. |
| 3,229,049 | A | 1/1966 | Goldberg |
| 3,440,314 | A | 4/1969 | Eldon |
| 3,449,768 | A | 6/1969 | James |

(Continued)

FOREIGN PATENT DOCUMENTS

| | | | |
|---|---|---|---|
| AU | 2004301961 | A1 | 2/2005 |
| CA | 2242545 | C | 9/2009 |

(Continued)

OTHER PUBLICATIONS

Asbeck, et al. Scaling Hard Vertical Surfaces with Compliant Microspine Arrays, The International Journal of Robotics Research 2006; 25; 1165-79.

(Continued)

*Primary Examiner* — Amir H Etesam
(74) *Attorney, Agent, or Firm* — Wilson Sonsini Goodrich and Rosati, P.C.

(57) ABSTRACT

An ear tip apparatus for use with a hearing device is provided and comprises a malleable structure. The malleable structure is sized and configured for placement in an ear canal of a user. The malleable structure is deformable to allow an adjustable venting of the ear canal, thereby minimizing the occlusion effect. Methodology for adjusting a degree of venting of the ear canal is also provided, including the automatic adjustments. Adjusting the degree of venting may be done in response to one or more of detected feedback or an environmental cue.

9 Claims, 17 Drawing Sheets

(56) References Cited

U.S. PATENT DOCUMENTS 3,526,949 A 9/1970 Frank
3,549,818 A 12/1970 Justin
3,585,416 A 6/1971 Howard
3,594,514 A 7/1971 Robert
3,710,399 A 1/1973 Hurst
3,712,962 A 1/1973 Epley
3,764,748 A 10/1973 Branch et al.
3,808,179 A 4/1974 Gaylord
3,870,832 A 3/1975 Fredrickson
3,882,285 A 5/1975 Nunley et al.
3,965,430 A 6/1976 Brandt
3,985,977 A 10/1976 Beaty et al.
4,002,897 A 1/1977 Kleinman et al.
4,031,318 A 6/1977 Pitre
4,061,972 A 12/1977 Burgess
4,075,042 A 2/1978 Das
4,098,277 A 7/1978 Mendell
4,109,116 A 8/1978 Victoreen
4,120,570 A 10/1978 Gaylord
4,207,441 A 6/1980 Chouard et al.
4,248,899 A 2/1981 Lyon et al.
4,252,440 A 2/1981 Frosch et al.
4,281,419 A 8/1981 Treace
4,303,772 A 12/1981 Novicky
4,319,359 A 3/1982 Wolf
4,334,315 A 6/1982 Ono et al.
4,334,321 A 6/1982 Edelman
4,338,929 A 7/1982 Lundin et al.
4,339,954 A 7/1982 Anson et al.
4,357,497 A 11/1982 Hochmair et al.
4,380,689 A 4/1983 Giannetti
4,428,377 A 1/1984 Zollner et al.
4,524,294 A 6/1985 Brody
4,540,761 A 9/1985 Kawamura et al.
4,556,122 A 12/1985 Goode
4,592,087 A 5/1986 Killion et al.
4,606,329 A 8/1986 Hough
4,611,598 A 9/1986 Hortmann et al.
4,628,907 A 12/1986 Epley
4,641,377 A 2/1987 Rush et al.
4,652,414 A 3/1987 Schlaegel
4,654,554 A 3/1987 Kishi
4,689,819 A 8/1987 Killion et al.
4,696,287 A 9/1987 Hortmann et al.
4,729,366 A 3/1988 Schaefer
4,741,339 A 5/1988 Harrison et al.
4,742,499 A 5/1988 Butler
4,756,312 A 7/1988 Epley
4,759,070 A 7/1988 Voroba et al.
4,766,607 A 8/1988 Feldman
4,774,933 A 10/1988 Hough et al.
4,776,322 A 10/1988 Hough et al.
4,782,818 A 11/1988 Mori
4,800,884 A 1/1989 Heide et al.
4,800,982 A 1/1989 Carlson
4,817,607 A 4/1989 Tatge
4,840,178 A 6/1989 Heide et al.
4,845,755 A 7/1989 Busch et al.
4,865,035 A 9/1989 Mori
4,870,688 A 9/1989 Voroba et al.
4,918,745 A 4/1990 Hutchison
4,932,405 A 6/1990 Peeters et al.
4,936,305 A 6/1990 Ashtiani et al.
4,944,301 A 7/1990 Widin et al.
4,948,855 A 8/1990 Novicky
4,957,478 A 9/1990 Maniglia
4,963,963 A 10/1990 Dorman
4,982,434 A 1/1991 Lenhardt et al.
4,999,819 A 3/1991 Newnham et al.
5,003,608 A 3/1991 Carlson
5,012,520 A 4/1991 Steeger
5,015,224 A 5/1991 Maniglia
5,015,225 A 5/1991 Hough et al.
5,031,219 A 7/1991 Ward et al.
5,061,282 A 10/1991 Jacobs
5,066,091 A 11/1991 Stoy et al.
5,068,902 A 11/1991 Ward
5,094,108 A 3/1992 Kim et al.
5,117,461 A 5/1992 Moseley
5,142,186 A 8/1992 Cross et al.
5,163,957 A 11/1992 Sade et al.
5,167,235 A 12/1992 Seacord et al.
5,201,007 A 4/1993 Ward et al.
5,220,612 A 6/1993 Tibbetts et al.
5,259,032 A 11/1993 Perkins et al.
5,272,757 A 12/1993 Scofield et al.
5,276,910 A 1/1994 Buchele
5,277,694 A 1/1994 Leysieffer et al.
5,282,858 A 2/1994 Bisch et al.
5,298,692 A 3/1994 Ikeda et al.
5,338,287 A 8/1994 Miller et al.
5,360,388 A 11/1994 Spindel et al.
5,378,933 A 1/1995 Pfannenmueller et al.
5,402,496 A 3/1995 Soli et al.
5,411,467 A 5/1995 Hortmann et al.
5,425,104 A 6/1995 Shennib
5,440,082 A 8/1995 Claes
5,440,237 A 8/1995 Brown et al.
5,455,994 A 10/1995 Termeer et al.
5,456,654 A 10/1995 Ball
5,531,787 A 7/1996 Lesinski et al.
5,531,954 A 7/1996 Heide et al.
5,535,282 A 7/1996 Luca
5,554,096 A 9/1996 Ball
5,558,618 A 9/1996 Maniglia
5,571,148 A 11/1996 Loeb et al.
5,572,594 A 11/1996 Devoe et al.
5,606,621 A 2/1997 Reiter et al.
5,624,376 A 4/1997 Ball et al.
5,654,530 A 8/1997 Sauer et al.
5,692,059 A 11/1997 Kruger
5,699,809 A 12/1997 Combs et al.
5,701,348 A 12/1997 Shennib et al.
5,707,338 A 1/1998 Adams et al.
5,715,321 A 2/1998 Andrea et al.
5,721,783 A 2/1998 Anderson
5,722,411 A 3/1998 Suzuki et al.
5,729,077 A 3/1998 Newnham et al.
5,740,258 A 4/1998 Goodwin-Johansson
5,742,692 A 4/1998 Garcia et al.
5,749,912 A 5/1998 Zhang et al.
5,762,583 A 6/1998 Adams et al.
5,772,575 A 6/1998 Lesinski et al.
5,774,259 A 6/1998 Saitoh et al.
5,782,744 A 7/1998 Money
5,788,711 A 8/1998 Lehner et al.
5,795,287 A 8/1998 Ball et al.
5,797,834 A 8/1998 Goode
5,800,336 A 9/1998 Ball et al.
5,804,109 A 9/1998 Perkins
5,804,907 A 9/1998 Park et al.
5,814,095 A 9/1998 Mueller et al.
5,824,022 A 10/1998 Zilberman et al.
5,825,122 A 10/1998 Givargizov et al.
5,836,863 A 11/1998 Bushek et al.
5,842,967 A 12/1998 Kroll
5,851,199 A 12/1998 Peerless et al.
5,857,958 A 1/1999 Ball et al.
5,859,916 A 1/1999 Ball et al.
5,868,682 A 2/1999 Combs et al.
5,879,283 A 3/1999 Adams et al.
5,888,187 A 3/1999 Jaeger et al.
5,897,486 A 4/1999 Ball et al.
5,899,847 A 5/1999 Adams et al.
5,900,274 A 5/1999 Chatterjee et al.
5,906,635 A 5/1999 Maniglia
5,913,815 A 6/1999 Ball et al.
5,922,017 A 7/1999 Bredberg et al.
5,922,077 A 7/1999 Espy et al.
5,935,170 A 8/1999 Haakansson et al.
5,940,519 A 8/1999 Kuo
5,949,895 A 9/1999 Ball et al.
5,951,601 A 9/1999 Lesinski et al.
5,984,859 A 11/1999 Lesinski

(56) References Cited

U.S. PATENT DOCUMENTS 5,987,146 A 11/1999 Pluvinage et al.
6,001,129 A 12/1999 Bushek et al.
6,005,955 A 12/1999 Kroll et al.
6,011,984 A 1/2000 Van et al.
6,024,717 A 2/2000 Ball et al.
6,038,480 A 3/2000 Hrdlicka et al.
6,045,528 A 4/2000 Arenberg et al.
6,050,933 A 4/2000 Bushek et al.
6,068,589 A 5/2000 Neukermans
6,068,590 A 5/2000 Brisken
6,072,884 A 6/2000 Kates
6,084,975 A 7/2000 Perkins
6,093,144 A 7/2000 Jaeger et al.
6,135,612 A 10/2000 Clore
6,137,889 A 10/2000 Shennib et al.
6,139,488 A 10/2000 Ball
6,153,966 A 11/2000 Neukermans
6,168,948 B1 1/2001 Anderson et al.
6,174,278 B1 1/2001 Jaeger et al.
6,175,637 B1 1/2001 Fujihira et al.
6,181,801 B1 1/2001 Puthuff et al.
6,190,305 B1 2/2001 Ball et al.
6,190,306 B1 2/2001 Kennedy
6,208,445 B1 3/2001 Reime
6,216,040 B1 4/2001 Harrison
6,217,508 B1 4/2001 Ball et al.
6,219,427 B1 4/2001 Kates et al.
6,222,302 B1 4/2001 Imada et al.
6,222,927 B1 4/2001 Feng et al.
6,240,192 B1 5/2001 Brennan et al.
6,241,767 B1 6/2001 Stennert et al.
6,259,951 B1 7/2001 Kuzma et al.
6,261,224 B1 7/2001 Adams et al.
6,264,603 B1 7/2001 Kennedy
6,277,148 B1 8/2001 Dormer
6,312,959 B1 11/2001 Datskos
6,339,648 B1 1/2002 McIntosh et al.
6,342,035 B1 1/2002 Kroll et al.
6,354,990 B1 3/2002 Juneau et al.
6,359,993 B2 * 3/2002 Brimhall ..... H04R 25/456 381/322
6,366,863 B1 4/2002 Bye et al.
6,374,143 B1 4/2002 Berrang et al.
6,385,363 B1 5/2002 Rajic et al.
6,387,039 B1 5/2002 Moses
6,390,971 B1 5/2002 Adams et al.
6,393,130 B1 5/2002 Stonikas et al.
6,422,991 B1 7/2002 Jaeger
6,432,248 B1 8/2002 Popp et al.
6,434,246 B1 8/2002 Kates et al.
6,434,247 B1 8/2002 Kates et al.
6,436,028 B1 8/2002 Dormer
6,438,244 B1 8/2002 Juneau et al.
6,445,799 B1 9/2002 Taenzer et al.
6,473,512 B1 10/2002 Juneau et al.
6,475,134 B1 11/2002 Ball et al.
6,491,622 B1 12/2002 Kasic, II et al.
6,491,644 B1 12/2002 Vujanic et al.
6,491,722 B1 12/2002 Kroll et al.
6,493,453 B1 12/2002 Glendon
6,493,454 B1 12/2002 Loi et al.
6,498,858 B2 12/2002 Kates
6,507,758 B1 1/2003 Greenberg et al.
6,519,376 B2 2/2003 Biagi et al.
6,523,985 B2 2/2003 Hamanaka et al.
6,536,530 B2 3/2003 Schultz et al.
6,537,200 B2 3/2003 Leysieffer et al.
6,547,715 B1 4/2003 Mueller et al.
6,549,633 B1 4/2003 Westermann
6,549,635 B1 4/2003 Gebert
6,554,761 B1 4/2003 Puria et al.
6,575,894 B2 6/2003 Leysieffer et al.
6,592,513 B1 7/2003 Kroll et al.
6,603,860 B1 8/2003 Taenzer et al.
6,620,110 B2 9/2003 Schmid
6,626,822 B1 9/2003 Jaeger et al.
6,629,922 B1 10/2003 Puria et al.
6,631,196 B1 10/2003 Taenzer et al.
6,643,378 B2 11/2003 Schumaier
6,663,575 B2 12/2003 Leysieffer
6,668,062 B1 12/2003 Luo et al.
6,676,592 B2 1/2004 Ball et al.
6,681,022 B1 1/2004 Puthuff et al.
6,695,943 B2 2/2004 Juneau et al.
6,697,674 B2 2/2004 Leysieffer
6,724,902 B1 4/2004 Shennib et al.
6,726,618 B2 4/2004 Miller
6,726,718 B1 4/2004 Carlyle et al.
6,727,789 B2 4/2004 Tibbetts et al.
6,728,024 B2 4/2004 Ribak
6,735,318 B2 5/2004 Cho
6,754,358 B1 6/2004 Boesen et al.
6,754,359 B1 6/2004 Svean et al.
6,754,537 B1 6/2004 Harrison et al.
6,785,394 B1 8/2004 Olsen et al.
6,792,114 B1 9/2004 Kates et al.
6,801,629 B2 10/2004 Brimhall et al.
6,829,363 B2 12/2004 Sacha
6,831,986 B2 12/2004 Kates
6,837,857 B2 1/2005 Stirnemann
6,842,647 B1 1/2005 Griffith et al.
6,888,949 B1 5/2005 Vanden et al.
6,900,926 B2 5/2005 Ribak
6,912,289 B2 6/2005 Vonlanthen et al.
6,920,340 B2 7/2005 Laderman
6,931,231 B1 8/2005 Griffin
6,940,988 B1 9/2005 Shennib et al.
6,940,989 B1 9/2005 Shennib et al.
D512,979 S 12/2005 Corcoran et al.
6,975,402 B2 12/2005 Bisson et al.
6,978,159 B2 12/2005 Feng et al.
7,020,297 B2 3/2006 Fang et al.
7,024,010 B2 4/2006 Saunders et al.
7,043,037 B2 5/2006 Lichtblau et al.
7,050,675 B2 5/2006 Zhou et al.
7,050,876 B1 5/2006 Fu et al.
7,057,256 B2 6/2006 Mazur et al.
7,058,182 B2 6/2006 Kates
7,058,188 B1 6/2006 Allred
7,072,475 B1 7/2006 Denap et al.
7,076,076 B2 7/2006 Bauman
7,095,981 B1 8/2006 Voroba et al.
7,167,572 B1 1/2007 Harrison et al.
7,174,026 B2 2/2007 Niederdrank et al.
7,179,238 B2 2/2007 Hissong
7,181,034 B2 2/2007 Armstrong
7,203,331 B2 4/2007 Boesen
7,239,069 B2 7/2007 Cho
7,245,732 B2 7/2007 Jorgensen et al.
7,255,457 B2 8/2007 Ducharme et al.
7,266,208 B2 9/2007 Charvin et al.
7,289,639 B2 10/2007 Abel et al.
7,313,245 B1 12/2007 Shennib
7,315,211 B1 1/2008 Lee et al.
7,322,930 B2 1/2008 Jaeger et al.
7,349,741 B2 3/2008 Maltan et al.
7,354,792 B2 4/2008 Mazur et al.
7,376,563 B2 5/2008 Leysieffer et al.
7,390,689 B2 6/2008 Mazur et al.
7,394,909 B1 7/2008 Widmer et al.
7,421,087 B2 9/2008 Perkins et al.
7,424,122 B2 9/2008 Ryan
7,444,877 B2 11/2008 Li et al.
7,547,275 B2 6/2009 Cho et al.
7,630,646 B2 12/2009 Anderson et al.
7,645,877 B2 1/2010 Gmeiner et al.
7,668,325 B2 2/2010 Puria et al.
7,747,295 B2 6/2010 Choi
7,778,434 B2 * 8/2010 Juneau ..... A61F 11/10 381/322
7,809,150 B2 10/2010 Natarajan et al.
7,826,632 B2 11/2010 Von et al.
7,853,033 B2 12/2010 Maltan et al.
7,867,160 B2 1/2011 Pluvinage et al.

(56) References Cited

U.S. PATENT DOCUMENTS

| | | | |
|---|---|---|---|
| 7,883,535 | B2 | 2/2011 | Cantin et al. |
| 7,983,435 | B2 | 7/2011 | Moses |
| 8,090,134 | B2 | 1/2012 | Takigawa et al. |
| 8,116,494 | B2 | 2/2012 | Rass |
| 8,128,551 | B2 | 3/2012 | Jolly |
| 8,157,730 | B2 | 4/2012 | Leboeuf et al. |
| 8,197,461 | B1 | 6/2012 | Arenberg et al. |
| 8,204,786 | B2 | 6/2012 | Leboeuf et al. |
| 8,233,651 | B1 | 7/2012 | Haller |
| 8,251,903 | B2 | 8/2012 | Leboeuf et al. |
| 8,295,505 | B2 | 10/2012 | Weinans et al. |
| 8,295,523 | B2 | 10/2012 | Fay et al. |
| 8,320,601 | B2 | 11/2012 | Takigawa et al. |
| 8,320,982 | B2 | 11/2012 | Leboeuf et al. |
| 8,340,310 | B2 | 12/2012 | Ambrose et al. |
| 8,340,335 | B1 | 12/2012 | Shennib |
| 8,391,527 | B2 | 3/2013 | Feucht et al. |
| 8,396,239 | B2 | 3/2013 | Fay et al. |
| 8,401,212 | B2 | 3/2013 | Puria et al. |
| 8,401,214 | B2 | 3/2013 | Perkins et al. |
| 8,506,473 | B2 | 8/2013 | Puria |
| 8,512,242 | B2 | 8/2013 | Leboeuf et al. |
| 8,526,651 | B2 | 9/2013 | Van et al. |
| 8,526,652 | B2 | 9/2013 | Ambrose et al. |
| 8,526,971 | B2 | 9/2013 | Giniger et al. |
| 8,545,383 | B2 | 10/2013 | Wenzel et al. |
| 8,600,089 | B2 | 12/2013 | Wenzel et al. |
| 8,647,270 | B2 | 2/2014 | Leboeuf et al. |
| 8,652,040 | B2 | 2/2014 | Leboeuf et al. |
| 8,684,922 | B2 | 4/2014 | Tran |
| 8,696,054 | B2 | 4/2014 | Crum |
| 8,696,541 | B2 | 4/2014 | Pluvinage et al. |
| 8,700,111 | B2 | 4/2014 | Leboeuf et al. |
| 8,702,607 | B2 | 4/2014 | Leboeuf et al. |
| 8,715,152 | B2 | 5/2014 | Puria et al. |
| 8,715,153 | B2 | 5/2014 | Puria et al. |
| 8,715,154 | B2 | 5/2014 | Perkins et al. |
| 8,761,423 | B2 | 6/2014 | Wagner et al. |
| 8,787,609 | B2 | 7/2014 | Perkins et al. |
| 8,788,002 | B2 | 7/2014 | Leboeuf et al. |
| 8,817,998 | B2 | 8/2014 | Inoue |
| 8,824,715 | B2 | 9/2014 | Fay et al. |
| 8,845,705 | B2 | 9/2014 | Perkins et al. |
| 8,855,323 | B2 | 10/2014 | Kroman |
| 8,858,419 | B2 | 10/2014 | Puria et al. |
| 8,885,860 | B2 | 11/2014 | Djalilian et al. |
| 8,886,269 | B2 | 11/2014 | Leboeuf et al. |
| 8,888,701 | B2 | 11/2014 | Leboeuf et al. |
| 8,923,941 | B2 | 12/2014 | Leboeuf et al. |
| 8,929,965 | B2 | 1/2015 | Leboeuf et al. |
| 8,929,966 | B2 | 1/2015 | Leboeuf et al. |
| 8,934,952 | B2 | 1/2015 | Leboeuf et al. |
| 8,942,776 | B2 | 1/2015 | Leboeuf et al. |
| 8,961,415 | B2 | 2/2015 | Leboeuf et al. |
| 8,986,187 | B2 | 3/2015 | Perkins et al. |
| 8,989,830 | B2 | 3/2015 | Leboeuf et al. |
| 9,044,180 | B2 | 6/2015 | Leboeuf et al. |
| 9,049,528 | B2 | 6/2015 | Fay et al. |
| 9,055,379 | B2 | 6/2015 | Puria et al. |
| 9,131,312 | B2 | 9/2015 | Leboeuf et al. |
| 9,154,891 | B2 | 10/2015 | Puria et al. |
| 9,211,069 | B2 | 12/2015 | Larsen et al. |
| 9,226,083 | B2 | 12/2015 | Puria et al. |
| 9,277,335 | B2 | 3/2016 | Perkins et al. |
| 9,289,135 | B2 | 3/2016 | Leboeuf et al. |
| 9,289,175 | B2 | 3/2016 | Leboeuf et al. |
| 9,301,696 | B2 | 4/2016 | Leboeuf et al. |
| 9,314,167 | B2 | 4/2016 | Leboeuf et al. |
| 9,392,377 | B2 | 7/2016 | Olsen et al. |
| 9,427,191 | B2 | 8/2016 | Leboeuf et al. |
| 9,497,556 | B2 | 11/2016 | Kaltenbacher et al. |
| 9,521,962 | B2 | 12/2016 | Leboeuf |
| 9,524,092 | B2 | 12/2016 | Ren et al. |
| 9,538,921 | B2 | 1/2017 | Leboeuf et al. |
| 9,544,700 | B2 | 1/2017 | Puria et al. |
| 9,591,409 | B2 | 3/2017 | Puria et al. |
| 9,749,758 | B2 | 8/2017 | Puria et al. |
| 9,750,462 | B2 | 9/2017 | Leboeuf et al. |
| 9,788,785 | B2 | 10/2017 | Leboeuf |
| 9,788,794 | B2 | 10/2017 | Leboeuf et al. |
| 9,794,653 | B2 | 10/2017 | Aumer et al. |
| 9,801,552 | B2 | 10/2017 | Romesburg et al. |
| 9,808,204 | B2 | 11/2017 | Leboeuf et al. |
| 9,949,045 | B2 | 4/2018 | Kure et al. |
| 9,964,672 | B2 | 5/2018 | Phair et al. |
| 10,003,888 | B2 | 6/2018 | Stephanou et al. |
| 10,206,045 | B2 | 2/2019 | Kaltenbacher et al. |
| 2001/0003788 | A1 | 6/2001 | Ball et al. |
| 2001/0007050 | A1 | 7/2001 | Adelman |
| 2001/0024507 | A1 | 9/2001 | Boesen |
| 2001/0027342 | A1 | 10/2001 | Dormer |
| 2001/0029313 | A1 | 10/2001 | Kennedy |
| 2001/0043708 | A1 | 11/2001 | Brimhall |
| 2001/0053871 | A1 | 12/2001 | Zilberman et al. |
| 2001/0055405 | A1 | 12/2001 | Cho |
| 2002/0012438 | A1 | 1/2002 | Leysieffer et al. |
| 2002/0025055 | A1 | 2/2002 | Stonikas et al. |
| 2002/0029070 | A1 | 3/2002 | Leysieffer et al. |
| 2002/0030871 | A1 | 3/2002 | Anderson et al. |
| 2002/0035309 | A1 | 3/2002 | Leysieffer |
| 2002/0048374 | A1 | 4/2002 | Soli et al. |
| 2002/0085728 | A1 | 7/2002 | Shennib et al. |
| 2002/0086715 | A1 | 7/2002 | Sahagen |
| 2002/0172350 | A1 | 11/2002 | Edwards et al. |
| 2002/0183587 | A1 | 12/2002 | Dormer |
| 2003/0021903 | A1 | 1/2003 | Shlenker et al. |
| 2003/0055311 | A1 | 3/2003 | Neukermans et al. |
| 2003/0064746 | A1 | 4/2003 | Rader et al. |
| 2003/0081803 | A1 | 5/2003 | Petilli et al. |
| 2003/0097178 | A1 | 5/2003 | Roberson et al. |
| 2003/0125602 | A1 | 7/2003 | Sokolich et al. |
| 2003/0142841 | A1 | 7/2003 | Wiegand |
| 2003/0208099 | A1 | 11/2003 | Ball |
| 2003/0208888 | A1 | 11/2003 | Fearing et al. |
| 2003/0220536 | A1 | 11/2003 | Hissong |
| 2004/0019294 | A1 | 1/2004 | Stirnemann |
| 2004/0093040 | A1 | 5/2004 | Boylston et al. |
| 2004/0121291 | A1 | 6/2004 | Knapp et al. |
| 2004/0158157 | A1 | 8/2004 | Jensen et al. |
| 2004/0165742 | A1 | 8/2004 | Shennib et al. |
| 2004/0166495 | A1 | 8/2004 | Greinwald et al. |
| 2004/0167377 | A1 | 8/2004 | Schafer et al. |
| 2004/0184732 | A1 | 9/2004 | Zhou et al. |
| 2004/0190734 | A1 | 9/2004 | Kates |
| 2004/0202339 | A1 | 10/2004 | O'Brien et al. |
| 2004/0202340 | A1 | 10/2004 | Armstrong et al. |
| 2004/0208333 | A1 | 10/2004 | Cheung et al. |
| 2004/0234089 | A1 | 11/2004 | Rembrand et al. |
| 2004/0234092 | A1 | 11/2004 | Wada et al. |
| 2004/0236416 | A1 | 11/2004 | Falotico |
| 2004/0240691 | A1 | 12/2004 | Grafenberg |
| 2005/0018859 | A1 | 1/2005 | Buchholz |
| 2005/0020873 | A1 | 1/2005 | Berrang et al. |
| 2005/0036639 | A1 | 2/2005 | Bachler et al. |
| 2005/0038498 | A1 | 2/2005 | Dubrow et al. |
| 2005/0088435 | A1 | 4/2005 | Geng |
| 2005/0101830 | A1 | 5/2005 | Easter et al. |
| 2005/0111683 | A1 | 5/2005 | Chabries et al. |
| 2005/0117765 | A1 | 6/2005 | Meyer et al. |
| 2005/0163333 | A1 | 7/2005 | Abel et al. |
| 2005/0190939 | A1 | 9/2005 | Fretz et al. |
| 2005/0196005 | A1 | 9/2005 | Shennib et al. |
| 2005/0226446 | A1 | 10/2005 | Luo et al. |
| 2005/0267549 | A1 | 12/2005 | Della et al. |
| 2005/0271870 | A1 | 12/2005 | Jackson |
| 2005/0288739 | A1 | 12/2005 | Hassler, Jr. et al. |
| 2006/0015155 | A1 | 1/2006 | Charvin et al. |
| 2006/0023908 | A1 | 2/2006 | Perkins et al. |
| 2006/0058573 | A1 | 3/2006 | Neisz et al. |
| 2006/0062420 | A1 | 3/2006 | Araki |
| 2006/0074159 | A1 | 4/2006 | Lu et al. |
| 2006/0075175 | A1 | 4/2006 | Jensen et al. |
| 2006/0107744 | A1 | 5/2006 | Li et al. |
| 2006/0129210 | A1 | 6/2006 | Cantin et al. |

(56) References Cited

U.S. PATENT DOCUMENTS

2006/0161227 A1 7/2006 Walsh et al.
2006/0161255 A1 7/2006 Zarowski et al.
2006/0177079 A1 8/2006 Baekgaard et al.
2006/0177082 A1 8/2006 Solomito et al.
2006/0183965 A1 8/2006 Kasic et al.
2006/0189841 A1 8/2006 Pluvinage et al.
2006/0231914 A1 10/2006 Carey, III et al.
2006/0233398 A1 10/2006 Husung
2006/0237126 A1 10/2006 Guffrey et al.
2006/0247735 A1 11/2006 Honert et al.
2006/0251278 A1 11/2006 Puria et al.
2006/0256989 A1 11/2006 Olsen et al.
2006/0278245 A1 12/2006 Gan
2007/0030990 A1 2/2007 Fischer
2007/0036377 A1 2/2007 Stirnemann
2007/0076913 A1 4/2007 Schanz
2007/0083078 A1 4/2007 Easter et al.
2007/0100197 A1 5/2007 Perkins et al.
2007/0127748 A1 6/2007 Carlile et al.
2007/0127752 A1 6/2007 Armstrong
2007/0127766 A1 6/2007 Combest
2007/0135870 A1 6/2007 Shanks et al.
2007/0161848 A1 7/2007 Dalton et al.
2007/0191673 A1 8/2007 Ball et al.
2007/0201713 A1 8/2007 Fang et al.
2007/0206825 A1 9/2007 Thomasson
2007/0223755 A1 9/2007 Salvetti et al.
2007/0225776 A1 9/2007 Fritsch et al.
2007/0236704 A1 10/2007 Carr et al.
2007/0250119 A1 10/2007 Tyler et al.
2007/0251082 A1 11/2007 Milojevic et al.
2007/0286429 A1 12/2007 Grafenberg et al.
2008/0021518 A1 1/2008 Hochmair et al.
2008/0051623 A1 2/2008 Schneider et al.
2008/0054509 A1 3/2008 Berman et al.
2008/0063228 A1 3/2008 Mejia et al.
2008/0063231 A1 3/2008 Juneau et al.
2008/0064918 A1 3/2008 Jolly
2008/0077198 A1 3/2008 Webb et al.
2008/0089292 A1 4/2008 Kitazoe et al.
2008/0107292 A1 5/2008 Kornagel
2008/0123866 A1 5/2008 Rule et al.
2008/0130927 A1 6/2008 Theverapperuma et al.
2008/0188707 A1 8/2008 Bernard et al.
2008/0298600 A1 12/2008 Poe et al.
2008/0300703 A1 12/2008 Widmer et al.
2009/0016553 A1 1/2009 Ho et al.
2009/0023976 A1 1/2009 Cho et al.
2009/0043149 A1 2/2009 Abel et al.
2009/0076581 A1 3/2009 Gibson
2009/0092271 A1 4/2009 Fay et al.
2009/0097681 A1 4/2009 Puria et al.
2009/0131742 A1 5/2009 Cho et al.
2009/0141919 A1 6/2009 Spitaels et al.
2009/0149697 A1 6/2009 Steinhardt et al.
2009/0157143 A1 6/2009 Edler et al.
2009/0175474 A1 7/2009 Salvetti et al.
2009/0246627 A1 10/2009 Park
2009/0253951 A1 10/2009 Ball et al.
2009/0262966 A1 10/2009 Vestergaard et al.
2009/0281367 A1 11/2009 Cho et al.
2009/0310805 A1 12/2009 Petroff
2009/0316922 A1 12/2009 Merks et al.
2010/0034409 A1 2/2010 Fay et al.
2010/0036488 A1 2/2010 de Juan, Jr. et al.
2010/0048982 A1 2/2010 Puria et al.
2010/0085176 A1 4/2010 Flick
2010/0103404 A1 4/2010 Remke et al.
2010/0111315 A1 5/2010 Kroman
2010/0114190 A1 5/2010 Bendett et al.
2010/0145135 A1 6/2010 Ball et al.
2010/0152527 A1 6/2010 Puria
2010/0171369 A1 7/2010 Baarman et al.
2010/0172507 A1 7/2010 Merks
2010/0177918 A1 7/2010 Keady et al.
2010/0202645 A1 8/2010 Puria et al.
2010/0222639 A1 9/2010 Purcell et al.
2010/0260364 A1 10/2010 Merks
2010/0272299 A1 10/2010 Van et al.
2010/0290653 A1 11/2010 Wiggins et al.
2010/0312040 A1 12/2010 Puria et al.
2011/0069852 A1 3/2011 Arndt et al.
2011/0077453 A1 3/2011 Pluvinage et al.
2011/0112462 A1 5/2011 Parker et al.
2011/0116666 A1 5/2011 Dittberner et al.
2011/0125222 A1 5/2011 Perkins et al.
2011/0130622 A1 6/2011 Ilberg et al.
2011/0142274 A1 6/2011 Perkins et al.
2011/0144414 A1 6/2011 Spearman et al.
2011/0144719 A1 6/2011 Perkins et al.
2011/0152601 A1 6/2011 Puria et al.
2011/0152602 A1 6/2011 Perkins et al.
2011/0152603 A1 6/2011 Perkins et al.
2011/0152976 A1 6/2011 Perkins et al.
2011/0164771 A1 7/2011 Jensen et al.
2011/0182453 A1 7/2011 Van et al.
2011/0221391 A1 9/2011 Won et al.
2011/0249845 A1 10/2011 Kates
2011/0249847 A1 10/2011 Salvetti et al.
2011/0258839 A1 10/2011 Probst
2011/0271965 A1 11/2011 Parkins et al.
2012/0008807 A1 1/2012 Gran
2012/0014546 A1 1/2012 Puria et al.
2012/0038881 A1 2/2012 Amirparviz et al.
2012/0039493 A1 2/2012 Rucker et al.
2012/0114157 A1 5/2012 Arndt et al.
2012/0140967 A1 6/2012 Aubert et al.
2012/0217087 A1 8/2012 Ambrose et al.
2012/0236524 A1 9/2012 Pugh et al.
2013/0004004 A1 1/2013 Zhao et al.
2013/0034258 A1 2/2013 Lin
2013/0083938 A1 4/2013 Bakalos et al.
2013/0089227 A1 4/2013 Kates
2013/0230204 A1 9/2013 Monahan et al.
2013/0287239 A1 10/2013 Fay et al.
2013/0303835 A1 11/2013 Koskowich
2013/0308782 A1 11/2013 Dittberner et al.
2013/0308807 A1 11/2013 Burns
2013/0315428 A1 11/2013 Perkins et al.
2013/0343584 A1 12/2013 Bennett et al.
2013/0343585 A1 12/2013 Bennett et al.
2013/0343587 A1 12/2013 Naylor et al.
2014/0003640 A1 1/2014 Puria et al.
2014/0056453 A1 2/2014 Olsen et al.
2014/0153761 A1 6/2014 Shennib et al.
2014/0169603 A1 6/2014 Sacha et al.
2014/0254856 A1 9/2014 Blick et al.
2014/0275734 A1 9/2014 Perkins et al.
2014/0286514 A1 9/2014 Pluvinage et al.
2014/0288356 A1 9/2014 Van
2014/0288358 A1 9/2014 Puria et al.
2014/0296620 A1 10/2014 Puria et al.
2014/0321657 A1 10/2014 Stirnemann
2014/0379874 A1 12/2014 Starr et al.
2015/0021568 A1 1/2015 Gong et al.
2015/0023540 A1 1/2015 Fay et al.
2015/0031941 A1 1/2015 Perkins et al.
2015/0124985 A1 5/2015 Kim et al.
2015/0201269 A1 7/2015 Dahl et al.
2015/0222978 A1 8/2015 Murozaki et al.
2015/0245131 A1 8/2015 Facteau et al.
2015/0271609 A1 9/2015 Puria
2015/0358743 A1 12/2015 Killion
2016/0008176 A1 1/2016 Goldstein
2016/0029132 A1 1/2016 Freed et al.
2016/0064814 A1 3/2016 Jang et al.
2016/0066101 A1 3/2016 Puria et al.
2016/0094043 A1 3/2016 Hao et al.
2016/0150331 A1 5/2016 Wenzel
2016/0183017 A1 6/2016 Rucker et al.
2016/0277854 A1 9/2016 Puria et al.
2016/0302011 A1 10/2016 Olsen et al.
2016/0309265 A1 10/2016 Pluvinage et al.
2016/0309266 A1 10/2016 Olsen et al.

(56) References Cited

U.S. PATENT DOCUMENTS

| | | | |
|---|---|---|---|
| 2017/0040012 | A1 | 2/2017 | Goldstein |
| 2017/0095167 | A1 | 4/2017 | Facteau et al. |
| 2017/0095202 | A1 | 4/2017 | Facteau et al. |
| 2017/0134866 | A1 | 5/2017 | Puria et al. |
| 2017/0150275 | A1 | 5/2017 | Puria et al. |
| 2017/0195801 | A1 | 7/2017 | Rucker et al. |
| 2017/0195804 | A1 | 7/2017 | Sandhu et al. |
| 2017/0195806 | A1 | 7/2017 | Atamaniuk et al. |
| 2017/0195809 | A1 | 7/2017 | Teran et al. |
| 2018/0077503 | A1 | 3/2018 | Shaquer et al. |
| 2018/0077504 | A1 | 3/2018 | Shaquer et al. |
| 2018/0167750 | A1 | 6/2018 | Freed et al. |
| 2018/0213331 | A1 | 7/2018 | Rucker et al. |
| 2018/0213335 | A1 | 7/2018 | Puria et al. |
| 2018/0262846 | A1 | 9/2018 | Perkins et al. |
| 2018/0317026 | A1 | 11/2018 | Puria |
| 2019/0069097 | A1 | 2/2019 | Perkins et al. |

FOREIGN PATENT DOCUMENTS

| | | | |
|---|---|---|---|
| CN | 1176731 | A | 3/1998 |
| CN | 101459868 | A | 6/2009 |
| DE | 2044870 | A1 | 3/1972 |
| DE | 3243850 | A1 | 5/1984 |
| DE | 3508830 | A1 | 9/1986 |
| EP | 0092822 | A2 | 11/1983 |
| EP | 0242038 | A2 | 10/1987 |
| EP | 0291325 | A2 | 11/1988 |
| EP | 0296092 | A2 | 12/1988 |
| EP | 0242038 | A3 | 5/1989 |
| EP | 0296092 | A3 | 8/1989 |
| EP | 0352954 | A2 | 1/1990 |
| EP | 0291325 | A3 | 6/1990 |
| EP | 0352954 | A3 | 8/1991 |
| EP | 1035753 | A1 | 9/2000 |
| EP | 1435757 | A1 | 7/2004 |
| EP | 1845919 | A1 | 10/2007 |
| EP | 1955407 | A1 | 8/2008 |
| EP | 1845919 | B1 | 9/2010 |
| EP | 2272520 | A1 | 1/2011 |
| EP | 2301262 | A1 | 3/2011 |
| EP | 2752030 | A1 | 7/2014 |
| EP | 3101519 | A1 | 12/2016 |
| EP | 2425502 | B1 | 1/2017 |
| EP | 2907294 | B1 | 5/2017 |
| EP | 3183814 | A1 | 6/2017 |
| EP | 3094067 | B1 | 10/2017 |
| FR | 2455820 | A1 | 11/1980 |
| GB | 2085694 | A | 4/1982 |
| JP | S60154800 | A | 8/1985 |
| JP | S621726 | B2 | 1/1987 |
| JP | S63252174 | A | 10/1988 |
| JP | S6443252 | A | 2/1989 |
| JP | H09327098 | A | 12/1997 |
| JP | 2000504913 | A | 4/2000 |
| JP | 2004187953 | A | 7/2004 |
| JP | 2004193908 | A | 7/2004 |
| JP | 2005516505 | A | 6/2005 |
| JP | 2006060833 | A | 3/2006 |
| KR | 100624445 | B1 | 9/2006 |
| WO | WO-9209181 | A1 | 5/1992 |
| WO | WO-9501678 | A1 | 1/1995 |
| WO | WO-9621334 | A1 | 7/1996 |
| WO | WO-9736457 | A1 | 10/1997 |
| WO | WO-9745074 | A1 | 12/1997 |
| WO | WO-9806236 | A1 | 2/1998 |
| WO | WO-9903146 | A1 | 1/1999 |
| WO | WO-9915111 | A1 | 4/1999 |
| WO | WO-0022875 | A2 | 4/2000 |
| WO | WO-0022875 | A3 | 7/2000 |
| WO | WO-0150815 | A1 | 7/2001 |
| WO | WO-0158206 | A2 | 8/2001 |
| WO | WO-0176059 | A2 | 10/2001 |
| WO | WO-0158206 | A3 | 2/2002 |
| WO | WO-0239874 | A2 | 5/2002 |
| WO | WO-0239874 | A3 | 2/2003 |
| WO | WO-03030772 | A2 | 4/2003 |
| WO | WO-03063542 | A2 | 7/2003 |
| WO | WO-03063542 | A3 | 1/2004 |
| WO | WO-2004010733 | A1 | 1/2004 |
| WO | WO-2005015952 | A1 | 2/2005 |
| WO | WO-2005107320 | A1 | 11/2005 |
| WO | WO-2006014915 | A2 | 2/2006 |
| WO | WO-2006037156 | A1 | 4/2006 |
| WO | WO-2006039146 | A2 | 4/2006 |
| WO | WO-2006042298 | A2 | 4/2006 |
| WO | WO-2006071210 | A1 | 7/2006 |
| WO | WO-2006075169 | A1 | 7/2006 |
| WO | WO-2006075175 | A1 | 7/2006 |
| WO | WO-2006118819 | A2 | 11/2006 |
| WO | WO-2006042298 | A3 | 12/2006 |
| WO | WO-2007023164 | A1 | 3/2007 |
| WO | WO-2009046329 | A1 | 4/2009 |
| WO | WO-2009047370 | A2 | 4/2009 |
| WO | WO-2009049320 | A1 | 4/2009 |
| WO | WO-2009056167 | A1 | 5/2009 |
| WO | WO-2009062142 | A1 | 5/2009 |
| WO | WO-2009047370 | A3 | 7/2009 |
| WO | WO-2009125903 | A1 | 10/2009 |
| WO | WO-2009145842 | A2 | 12/2009 |
| WO | WO-2009146151 | A2 | 12/2009 |
| WO | WO-2009155358 | A1 | 12/2009 |
| WO | WO-2009155361 | A1 | 12/2009 |
| WO | WO-2009155385 | A1 | 12/2009 |
| WO | WO-2010033932 | A1 | 3/2010 |
| WO | WO-2010033933 | A1 | 3/2010 |
| WO | WO-2010077781 | A2 | 7/2010 |
| WO | WO-2010147935 | A1 | 12/2010 |
| WO | WO-2010148345 | A2 | 12/2010 |
| WO | WO-2011005500 | A2 | 1/2011 |
| WO | WO-2012088187 | A2 | 6/2012 |
| WO | WO-2012149970 | A1 | 11/2012 |
| WO | WO-2013016336 | A2 | 1/2013 |
| WO | WO-2016011044 | A1 | 1/2016 |
| WO | WO-2016045709 | A1 | 3/2016 |
| WO | WO-2017045700 | A1 | 3/2017 |
| WO | WO-2017059218 | A1 | 4/2017 |
| WO | WO-2017059240 | A1 | 4/2017 |
| WO | WO-2017116791 | A1 | 7/2017 |
| WO | WO-2017116865 | A1 | 7/2017 |
| WO | WO-2018048794 | A1 | 3/2018 |
| WO | WO-2018081121 | A1 | 5/2018 |

OTHER PUBLICATIONS

Atasoy [Paper] Opto-acoustic Imaging. For BYM504E Biomedical Imaging Systems class at ITU, downloaded from the Internet www2.itu.edu.td-cilesiz/courses/BYM504-2005-OA504041413.pdf, 14 pages.

Athanassiou, et al. Laser controlled photomechanical actuation of photochromic polymers Microsystems. Rev. Adv. Mater. Sci. 2003; 5:245-251.

Autumn, et al. Dynamics of geckos running vertically, The Journal of Experimental Biology 209, 260-272, (2006).

Autumn, et al., Evidence for van der Waals adhesion in gecko setae, www.pnas.orgycgiydoiy10.1073ypnas.192252799 (2002).

Ayatollahi, et al. Design and Modeling of Micromachined Condenser MEMS Loudspeaker using Permanent Magnet Neodymium-Iron-Boron (Nd—Fe—B). IEEE International Conference on Semiconductor Electronics, 2006. ICSE '06, Oct. 29, 2006-Dec. 1, 2006; 160-166.

Baer, et al. Effects of Low Pass Filtering on the Intelligibility of Speech in Noise for People With and Without Dead Regions at High Frequencies. J. Acost. Soc. Am 112 (3), pt. 1, (Sep. 2002), pp. 1133-1144.

Best, et al. The influence of high frequencies on speech localization. Abstract 981 (Feb. 24, 2003) from www.aro.org/abstracts/abstracts.html.

Birch, et al. Microengineered systems for the hearing impaired. IEE Colloquium on Medical Applications of Microengineering, Jan. 31, 1996; pp. 2/1-2/5.

(56) References Cited

OTHER PUBLICATIONS

Boedts. Tympanic epithelial migration, Clinical Otolaryngology 1978, 3, 249-253.
Burkhard, et al. Anthropometric Manikin for Acoustic Research. J. Acoust. Soc. Am., vol. 58, No. 1, (Jul. 1975), pp. 214-222.
Camacho-Lopez, et al. Fast Liquid Crystal Elastomer Swims Into the Dark, Electronic Liquid Crystal Communications. Nov. 26, 2003; 9 pages total.
Carlile, et al. Frequency bandwidth and multi-talker environments. Audio Engineering Society Convention 120. Audio Engineering Society, May 20-23, 2006. Paris, France. 118: 8 pages.
Carlile, et al. Spatialisation of talkers and the segregation of concurrent speech. Abstract 1264 (Feb. 24, 2004) from www.aro.org/abstracts/abstracts.html.
Cheng; et al., "A silicon microspeaker for hearing instruments. Journal of Micromechanics and Microengineering 14, No. 7 (2004): 859-866."
Cheng, et al. A Silicon Microspeaker for Hearing Instruments. Journal of Micromechanics and Microengineering 2004; 14(7):859-866.
Datskos, et al. Photoinduced and thermal stress in silicon microcantilevers. Applied Physics Letters. Oct. 19, 1998; 73(16):2319-2321.
Decraemer, et al. A method for determining three-dimensional vibration in the ear. Hearing Res., 77:19-37 (1994).
Ear. Downloaded from the Internet. Accessed Jun. 17, 2008. 4 pages. URL:<http://wwwmgs.bionet.nsc.ru/mgs/gnw/trrd/thesaurus/Se/ear.html>.
Fay. Cat eardrum mechanics. Ph.D. thesis. Disseration submitted to Department of Aeronautics and Astronautics. Standford University. May 2001; 210 pages total.
Fay, et al. Cat eardrum response mechanics. Mechanics and Computation Division. Department of Mechanical Engineering. Standford University. 2002; 10 pages total.
Fay, et al. Preliminary evaluation of a light-based contact hearing device for the hearing impaired. Otol Neurotol. Jul. 2013;34(5):912-21. doi: 10.1097/MAO.0b013e31827de4b1.
Fay, et al. The discordant eardrum, PNAS, Dec. 26, 2006, vol. 103, No. 52, p. 19743-19748.
Fletcher. Effects of Distortion on the Individual Speech Sounds. Chapter 18, ASA Edition of Speech and Hearing in Communication, Acoust Soc.of Am. (republished in 1995) pp. 415-423.
Freyman, et al. Spatial Release from Informational Masking in Speech Recognition. J. Acost. Soc. Am., vol. 109, No. 5, pt. 1, (May 2001); 2112-2122.
Freyman, et al. The Role of Perceived Spatial Separation in the Unmasking of Speech. J. Acoust. Soc. Am., vol. 106, No. 6, (Dec. 1999); 3578-3588.
Fritsch, et al. EarLens transducer behavior in high-field strength MRI scanners. Otolaryngol Head Neck Surg. Mar. 2009;140(3):426-8. doi: 10.1016/j.otohns.2008.10.016.
Gantz, et al. Broad Spectrum Amplification with a Light Driven Hearing System. Combined Otolaryngology Spring Meetings, 2016 (Chicago).
Gantz, et al. Light Driven Hearing Aid: A Multi-Center Clinical Study. Association for Research in Otolaryngology Annual Meeting, 2016 (San Diego).
Gantz, et al. Light-Driven Contact Hearing Aid for Broad Spectrum Amplification: Safety and Effectiveness Pivotal Study. Otology & Neurotology Journal, 2016 (in review).
Gantz, et al. Light-Driven Contact Hearing Aid for Broad-Spectrum Amplification: Safety and Effectiveness Pivotal Study. Otology & Neurotology. Copyright 2016. 7 pages.
Ge, et al., Carbon nanotube-based synthetic gecko tapes, p. 10792-10795, PNAS, Jun. 26, 2007, vol. 104, No. 26.
Gennum, GA3280 Preliminary Data Sheet: Voyageur TD Open Platform DSP System for Ultra Low Audio Processing, downloaded from the Internet:<<http://www.sounddesigntechnologies.com/products/pdf/37601DOC.pdf>>, Oct. 2006; 17 pages.
Gobin, et al. Comments on the physical basis of the active materials concept. Proc. SPIE 2003; 4512:84-92.
Gorb, et al. Structural Design and Biomechanics of Friction-Based Releasable Attachment Devices in Insects, Integr. Comp_ Biol., 42:1127-1139 (2002).
Hato, et al. Three-dimensional stapes footplate motion in human temporal bones. Audiol. Neurootol., 8:140-152 (Jan. 30, 2003).
Headphones. Wikipedia Entry. Downloaded from the Internet. Accessed Oct. 27, 2008. 7 pages. URL: http://en.wikipedia.org/wiki/Headphones>.
Hofman, et al. Relearning Sound Localization With New Ears. Nature Neuroscience, vol. 1, No. 5, (Sep. 1998); 417-421.
Izzo, et al. Laser Stimulation of Auditory Neurons: Effect of Shorter Pulse Duration and Penetration Depth. Biophys J. Apr. 15, 2008;94(8):3159-3166.
Izzo, et al. Laser Stimulation of the Auditory Nerve. Lasers Surg Med. Sep. 2006;38(8):745-753.
Izzo, et al. Selectivity of Neural Stimulation in the Auditory System: A Comparison of Optic and Electric Stimuli. J Biomed Opt. Mar.-Apr. 2007;12(2):021008.
Jian, et al. A 0.6 V, 1.66 mW energy harvester and audio driver for tympanic membrane transducer with wirelessly optical signal and power transfer. InCircuits and Systems (ISCAS), 2014 IEEE International Symposium on Jun. 1, 2014. 874-7. IEEE.
Jin, et al. Speech Localization. J. Audio Eng. Soc. convention paper, presented at the AES 112th Convention, Munich, Germany, May 10-13, 2002, 13 pages total.
Khaleghi, et al. Attenuating the ear canal feedback pressure of a laser-driven hearing aid. J Acoust Soc Am. Mar. 2017;141(3):1683.
Khaleghi, et al. Characterization of Ear-Canal Feedback Pressure due to Umbo-Drive Forces: Finite-Element vs. Circuit Models. ARO Midwinter Meeting 2016, (San Diego).
Killion, et al. The case of the missing dots: AI and SNR loss. The Hearing Journal, 1998. 51(5), 32-47.
Killion. Myths About Hearing Noise and Directional Microphones. The Hearing Review. Feb. 2004; 11(2):14, 16, 18, 19, 72 & 73.
Killion. SNR loss: I can hear what people say but I can't understand them. The Hearing Review, 1997; 4(12):8-14.
Lee, et al. A Novel Opto-Electromagnetic Actuator Coupled to the tympanic Membrane. J Biomech. Dec. 5, 2008;41(16):3515-8. Epub Nov. 7, 2008.
Lee, et al. The optimal magnetic force for a novel actuator coupled to the tympanic membrane: a finite element analysis. Biomedical engineering: applications, basis and communications. 2007; 19(3):171-177.
Levy, et al. Characterization of the available feedback gain margin at two device microphone locations, in the fossa triangularis and Behind the Ear, for the light-based contact hearing device. Acoustical Society of America (ASA) meeting, 2013 (San Francisco).
Levy, et al. Extended High-Frequency Bandwidth Improves Speech Reception in the Presence of Spatially Separated Masking Speech. Ear Hear. Sep.-Oct. 2015;36(5):e214-24. doi: 10.1097/AUD.0000000000000161.
Lezal. Chalcogenide glasses—survey and progress. Journal of Optoelectronics and Advanced Materials. Mar. 2003; 5(1):23-34.
Makino, et al. Epithelial migration in the healing process of tympanic membrane perforations. Eur Arch Otorhinolaryngol. 1990; 247: 352-355.
Makino, et al., Epithelial migration on the tympanic membrane and external canal, Arch Otorhinolaryngol (1986) 243:39-42.
Markoff. Intuition + Money: An Aha Moment. New York Times Oct. 11, 2008, p. BU4, 3 pages total.
Martin, et al. Utility of Monaural Spectral Cues is Enhanced in the Presence of Cues to Sound-Source Lateral Angle. JARO. 2004; 5:80-89.
Michaels, et al., Auditory Epithelial Migration on the Human Tympanic Membrane: II. The Existence of Two Discrete Migratory Pathways and Their Embryologic Correlates, The American Journal of Anatomy 189:189-200 (1990).
Moore, et al. Perceived naturalness of spectrally distorted speech and music. J Acoust Soc Am. Jul. 2003;114(1):408-19.
Moore, et al. Spectro-temporal characteristics of speech at high frequencies, and the potential for restoration of audibility to people

(56) References Cited

OTHER PUBLICATIONS with mild-to-moderate hearing loss. Ear Hear. Dec. 2008;29(6):907-22. doi: 10.1097/AUD.0b013e31818246f6.
Moore. Loudness perception and intensity resolution. Cochlear Hearing Loss, Chapter 4, pp. 90-115, Whurr Publishers Ltd., London (1998).
Murphy M, Aksak B, Sitti M. Adhesion and anisotropic friction enhancements of angled heterogeneous micro-fiber arrays with spherical and spatula tips. J Adhesion Sci Technol, vol. 21, No. 12-13, p. 1281-1296, 2007.
Murugasu, et al. Malleus-to-footplate versus malleus-to-stapes-head ossicular reconstruction prostheses: temporal bone pressure gain measurements and clinical audiological data. Otol Neurotol. Jul. 2005; 2694):572-582.
Musicant, et al. Direction-Dependent Spectral Properties of Cat External Ear: New Data and Cross-Species Comparisons. J. Acostic. Soc. Am, May 10-13, 2002, vol. 87, No. 2, (Feb. 1990), pp. 757-781.
National Semiconductor, LM4673 Boomer: Filterless, 2.65W, Mono, Class D Audio Power Amplifier, [Data Sheet] downloaded from the Internet:<<http://www.national.com/ds/LM/LM4673.pdf>>; Nov. 1, 2007; 24 pages.
Nishihara, et al. Effect of changes in mass on middle ear function. Otolaryngol Head Neck Surg. Nov. 1993;109(5):889-910.
O'Connor, et al. Middle ear Cavity and Ear Canal Pressure-Driven Stapes Velocity Responses in Human Cadaveric Temporal Bones. J Acoust Soc Am. Sep. 2006;120(3):1517-28.
Perkins, et al. Light-based Contact Hearing Device: Characterization of available Feedback Gain Margin at two device microphone locations. Presented at AAO-HNSF Annual Meeting, 2013 (Vancouver).
Perkins, et al. The EarLens Photonic Transducer: Extended bandwidth. Presented at AAO-HNSF Annual Meeting, 2011 (San Francisco).
Perkins, et al. The EarLens System: New sound transduction methods. Hear Res. Feb. 2, 2010; 10 pages total.
Perkins, R. Earlens tympanic contact transducer: a new method of sound transduction to the human ear. Otolaryngol Head Neck Surg. Jun. 1996;114(6):720-8.
Poosanaas, et al. Influence of sample thickness on the performance of photostrictive ceramics, J. App. Phys. Aug. 1, 1998; 84(3):1508-1512.
Puria et al. A gear in the middle ear. ARO Denver CO, 2007b.
Puria, et al. Cues above 4 kilohertz can improve spatially separated speech recognition. The Journal of the Acoustical Society of America, 2011, 129, 2384.
Puria, et al. Extending bandwidth above 4 kHz improves speech understanding in the presence of masking speech. Association for Research in Otolaryngology Annual Meeting, 2012 (San Diego).
Puria, et al. Extending bandwidth provides the brain what it needs to improve hearing in noise. First international conference on cognitive hearing science for communication, 2011 (Linkoping, Sweden).
Puria, et al. Hearing Restoration: Improved Multi-talker Speech Understanding. 5th International Symposium on Middle Ear Mechanics in Research and Otology (MEMRO), Jun. 2009 (Stanford University).
Puria, et al. Imaging, Physiology and Biomechanics of the middle ear: Towards understating the functional consequences of anatomy. Stanford Mechanics and Computation Symposium, 2005, ed Fong J.
Puria, et al. Malleus-to-footplate ossicular reconstruction prosthesis positioning: cochleovestibular pressure optimization. Otol Nerotol. May 2005; 2693):368-379.
Puria, et al. Measurements and model of the cat middle ear: Evidence of tympanic membrane acoustic delay. J. Acoust. Soc. Am., 104(6):3463-3481 (Dec. 1998).
Puria, et al., Mechano-Acoustical Transformations in A. Basbaum et al., eds., The Senses: A Comprehensive Reference, v3, p. 165-202, Academic Press (2008).
Puria, et al. Middle Ear Morphometry From Cadaveric Temporal Bone MicroCT Imaging. Proceedings of the 4th International Symposium, Zurich, Switzerland, Jul. 27-30, 2006, Middle Ear Mechanics in Research and Otology, pp. 259-268.
Puria, et al. Sound-Pressure Measurements in the Cochlear Vestibule of Human-Cadaver Ears. Journal of the Acoustical Society of America. 1997; 101 (5-1): 2754-2770.
Puria, et al. Temporal-Bone Measurements of the Maximum Equivalent Pressure Output and Maximum Stable Gain of a Light-Driven Hearing System That Mechanically Stimulates the Umbo. Otol Neurotol. Feb. 2016;37(2):160-6. doi: 10.1097/MAO.0000000000000941.
Puria, et al. The EarLens Photonic Hearing Aid. Association for Research in Otolaryngology Annual Meeting, 2012 (San Diego).
Puria, et al. The Effects of bandwidth and microphone location on understanding of masked speech by normal-hearing and hearing-impaired listeners. International Conference for Hearing Aid Research (IHCON) meeting, 2012 (Tahoe City).
Puria, et al. Tympanic-membrane and malleus-incus-complex co-adaptations for high-frequency hearing in mammals. Hear Res. May 2010;263(1-2):183-90. doi: 10.1016/j.heares.2009.10.013. Epub Oct. 28, 2009.
Puria. Measurements of human middle ear forward and reverse acoustics: implications for otoacoustic emissions. J Acoust Soc Am. May 2003;113(5):2773-89.
Puria, S. Middle Ear Hearing Devices. Chapter 10. Part of the series Springer Handbook of Auditory Research pp. 273-308. Date: Feb. 9, 2013.
Qu, et al. Carbon Nanotube Arrays with Strong Shear Binding-On and Easy Normal Lifting-Off, Oct. 10, 2008 vol. 322 Science. 238-242.
Roush. SiOnyx Brings "Black Silicon" into the Light; Material Could Upend Solar, Imaging Industries. Xconomy, Oct. 12, 2008, retrieved from the Internet: www.xconomy.com/boston/2008/10/12/sionyx-brings-black-silicon-into-the-light-material-could-upend-solar-imaging-industries> 4 pages total.
R.P. Jackson, C. Chlebicki, T.B. Krasieva, R. Zalpuri, W.J. Triffo, S. Puria, "Multiphoton and Transmission Electron Microscopy of Collagen in Ex Vivo Tympanic Membranes," Biomedcal Computation at STandford, Oct. 2008.
Rubinstein. How Cochlear Implants Encode Speech, Curr Opin Otolaryngol Head Neck Surg. Oct. 2004;12(5):444-8; retrieved from the Internet: www.ohsu.edu/nod/documents/week3/Rubenstein.pdf.
Sekaric, et al. Nanomechanical resonant structures as tunable passive modulators. App. Phys. Lett. Nov. 2003; 80(19):3617-3619.
Shaw. Transformation of Sound Pressure Level From the Free Field to the Eardrum in the Horizontal Plane. J. Acoust. Soc. Am., vol. 56, No. 6, (Dec. 1974), 1848-1861.
Shih. Shape and displacement control of beams with various boundary conditions via photostrictive optical actuators. Proc. IMECE. Nov. 2003; 1-10.
Song, et al. The development of a non-surgical direct drive hearing device with a wireless actuator coupled to the tympanic membrane. Applied Acoustics. Dec. 31, 2013;74(12):1511-8.
Sound Design Technologies,—Voyager TDTM Open Platform DSP System for Ultra Low Power Audio Processing—GA3280 Data Sheet. Oct. 2007; retrieved from the Internet:<<http://www.sounddes.com/pdf/37601DOC.pdf>>, 15 page total.
Spolenak, et al. Effects of contact shape on the scaling of biological attachments. Proc. R. Soc. A. 2005; 461:305-319.
Stenfelt, et al. Bone-Conducted Sound: Physiological and Clinical Aspects. Otology & Neurotology, Nov. 2005; 26 (6):1245-1261.
Struck, et al. Comparison of Real-world Bandwidth in Hearing Aids vs Earlens Light-driven Hearing Aid System. The Hearing Review. TechTopic: EarLens. Hearingreview.com. Mar. 14, 2017. pp. 24-28.
Stuchlik, et al. Micro-Nano Actuators Driven by Polarized Light. IEEE Proc. Sci. Meas. Techn. Mar. 2004; 151(2):131-136.
Suski, et al. Optically activated ZnO/Si02/Si cantilever beams. Sensors and Actuators A (Physical), 0 (nr: 24). 2003; 221-225.
Takagi, et al. Mechanochemical Synthesis of Piezoelectric PLZT Powder. KONA. 2003; 51(21):234-241.

(56) References Cited

OTHER PUBLICATIONS

Thakoor, et al. Optical microactuation in piezoceramics. Proc. SPIE. Jul. 1998; 3328:376-391.
The Scientist and Engineers Guide to Digital Signal Processing, copyright 01997-1998 by Steven W. Smith, available online at www.DSPguide.com.
Thompson. Tutorial on microphone technologies for directional hearing aids. Hearing Journal. Nov. 2003; 56(11):14-16,18, 20-21.
Tzou, et al. Smart Materials, Precision Sensors/Actuators, Smart Structures, and Structronic Systems. Mechanics of Advanced Materials and Structures. 2004; 11:367-393.
Uchino, et al. Photostricitve actuators. Ferroelectrics. 2001; 258:147-158.
Vickers, et al. Effects of Low-Pass Filtering on the Intelligibility of Speech in Quiet for People With and Without Dead Regions at High Frequencies. J. Acoust. Soc. Am. Aug. 2001; 110(2):1164-1175.
Vinikman-Pinhasi, et al. Piezoelectric and Piezooptic Effects in Porous Silicon. Applied Physics Letters, Mar. 2006; 88(11): 11905-111906.
Wang, et al. Preliminary Assessment of Remote Photoelectric Excitation of an Actuator for a Hearing Implant. Proceeding of the 2005 IEEE, Engineering in Medicine and Biology 27th nnual Conference, Shanghai, China. Sep. 1-4, 2005; 6233-6234.
Wiener, et al. On the Sound Pressure Transformation By the Head and Auditory Meatus of the Cat. Acta Otolaryngol. Mar. 1966; 61(3):255-269.
Wightman, et al. Monaural Sound Localization Revisited. J Acoust Soc Am. Feb. 1997;101(2):1050-1063.
Yao, et al. Adhesion and sliding response of a biologically inspired fibrillar surface: experimental observations, J. R. Soc. Interface (2008) 5, 723-733 doi:10.1098/rsif.2007.1225 Published online Oct. 30, 2007.
Yao, et al. Maximum strength for intermolecular adhesion of nanospheres at an optimal size. J. R. Soc. Interface doi:10.10981rsif. 2008.0066 Published online 2008.
Yi, et al. Piezoelectric Microspeaker with Compressive Nitride Diaphragm. The Fifteenth IEEE International Conference on Micro Electro Mechanical Systems, 2002; 260-263.
Yu, et al. Photomechanics: Directed bending of a polymer film by light. Nature. Sep. 2003; 425:145.
Co-pending U.S. Appl. No. 15/706,181, filed Sep. 15, 2017.
Co-pending U.S. Appl. No. 15/706,208, filed Sep. 15, 2017.
Co-pending U.S. Appl. No. 15/706,236, filed Sep. 15, 2017.
Co-pending U.S. Appl. No. 15/804,995, filed Nov. 6, 2017.
Notice of Allowance dated Jul. 14, 2017 for U.S. Appl. No. 14/554,606.
Notice of Allowance dated Nov. 15, 2017 for U.S. Appl. No. 14/554,606.
Office Action dated Jan. 6, 2017 for U.S. Appl. No. 14/554,606.
Dundas et al. The Earlens Light-Driven Hearing Aid: Top 10 questions and answers. Hearing Review. 2018;25(2):36-39.
Khaleghi et al. Attenuating the feedback pressure of a light-activated hearing device to allows microphone placement at the ear canal entrance. IHCON 2016, International Hearing Aid Research Conference, Tahoe City, CA, Aug. 2016.
Khaleghi et al. Mechano-Electro-Magnetic Finite Element Model of a Balanced Armature Transducer for a Contact Hearing Aid. Proc. MoH 2017, Mechanics of Hearing workshop, Brock University, Jun. 2017.
Khaleghi et al. Multiphysics Finite Element Model of a Balanced Armature Transducer used in a Contact Hearing Device. ARO 2017, 40th ARO MidWinter Meeting, Baltimore, MD, Feb. 2017.
Levy et al. Light-driven contact hearing aid: a removable direct-drive hearing device option for mild to severe sensorineural hearing impairment. Conference on Implantable Auditory Prostheses, Tahoe City, CA, Jul. 2017. 1 page.
McElveen et al. Overcoming High-Frequency Limitations of Air Conduction Hearing Devices Using a Light-Driven Contact Hearing Aid. Poster presentation at The Triological Society, 120th Annual Meeting at COSM, Apr. 28, 2017; San Diego, CA.
Park, et al. Design and analysis of a microelectromagnetic vibration transducer used as an implantable middle ear hearing aid. J. Micromech. Microeng. vol. 12 (2002), pp. 505-511.
Galbraith et al. A wide-band efficient inductive transdermal power and data link with coupling insensitive gain IEEE Trans Biomed Eng. Apr. 1987;34(4):265-75.
Kiessling, et al. Occlusion Effect of Earmolds with Different Venting Systems. J Am Acad Audiol. Apr. 2005;16(4):237-49.
School of Physics Sydney, Australia. Acoustic Compliance, Inertance and Impedance. 1-6. (2018). http://www.animations.physics.unsw.edu.au/jw/compliance-inertance-impedance.htm.
Wikipedia. Inductive Coupling. 1-2 (Jan. 11, 2018). https://en.wikipedia.org/wiki/Inductive_coupling.
Wikipedia. Pulse-density Coupling. 1-4 (Apr. 6, 2017). https://en.wikipedia.org/wiki/Pulse-density_modulation.
Vinge. Wireless Energy Transfer by Resonant Inductive Coupling. Master of Science Thesis. Chalmers University of Technology. 1-83 (2015).
Wikipedia. Resonant Inductive Coupling. 1-11 (Jan. 12, 2018). https://en.wikipedia.org/wiki/Resonant_inductive_coupling#cite_note-13.
Edinger, J.R. High-Quality Audio Amplifier With Automatic Bias Control. Audio Engineering; Jun. 1947; pp. 7-9.
Dictionary.com's (via American Heritage Medical Dictionary) online dictionary definition of 'percutaneous'. Accessed on Jun. 3, 2013. 2 pages.
Merriam-Webster's online dictionary definition of 'percutaneous'. Accessed on Jun. 3, 2013. 3 pages.
Hakansson, et al. Percutaneous vs. transcutaneous transducers for hearing by direct bone conduction (Abstract). Otolaryngol Head Neck Surg. Apr. 1990;102(4):339-44.
Mah. Fundamentals of photovoltaic materials. National Solar Power Research Institute. Dec. 21, 1998, 3-9.
Robles, et al. Mechanics of the mammalian cochlea. Physiol Rev. Jul. 2001;81(3):1305-52.
Web Books Publishing, "The Ear," accessed online Jan. 22, 2013, available online Nov. 2, 2007 at http://www.web-books.com/eLibrary/Medicine/Physiology/Ear/Ear.htm.
Wiki. Sliding Bias Variant 1, Dynamic Hearing (2015).

* cited by examiner 454 452

180

ADJUSTABLE VENTING FOR HEARING INSTRUMENTS

CROSS-REFERENCE

This application is a continuation of U.S. patent application Ser. No. 14/554,606, filed Nov. 26, 2014, which is incorporated herein by reference in its entirety.

BACKGROUND

The present disclosure relates generally to hearing systems, devices, and methods. Although specific reference is made to hearing aid systems, embodiments of the present disclosure can be used in many applications in which a diagnostic, treatment, or other device is placed in the ear.

Hearing is an important sense for people and allows them to listen to and understand others. Natural hearing can include spatial cues that allow a user to hear a speaker, even when background noise is present.

Hearing devices can be used with communication systems to help the hearing impaired. Hearing impaired subjects need hearing aids to verbally communicate with those around them. In-canal hearing aids have proven to be successful in the marketplace because of increased comfort and an improved cosmetic appearance. Many in-canal hearing aids, however, have issues with occlusion. Occlusion is an unnatural, tunnel-like hearing effect which can be caused by hearing aids which at least partially occlude the ear canal. In at least some instances, occlusion can be noticed by the user when he or she speaks and the occlusion results in an unnatural sound during speech. To reduce occlusion, many in-canal hearing aids have vents, channels, or other openings. These vents or channels allow air and sound to pass through the hearing aid, specifically between the lateral and medial parts of the ear canal adjacent the hearing aid placed in the ear canal.

In some cases, occlusion vents in current in-canal hearing aids are less than ideal. For example, many in-canal hearing devices have occlusion vents with fixed sizes, limiting the effectiveness of the occlusion vents. Generally, a user selects, with the help of an audiologist or doctor, the best sounding hearing aid from a choice of multiple hearing aids. The user then selects a set of vented or non-vented ear tips to provide the best sound at the point of sale. However, in daily life, the acoustic environment will change, and the sound provided by the chosen ear tips may not be best for every situation. Historically, when the acoustic environment changes, the user has only been able to adjust the loudness or volume of the hearing instrument or change the vented tips. Changing the volume can be done quickly without removing the hearing instrument. In contrast, changing the vents is cumbersome, requires removing the hearing instrument, and is best done with the help of a professional fitter, which make the adjustment process even less convenient. Moreover, merely replacing the ear tips in use will not compensate for changes to hearing that can occur in a dynamic environment.

The hearing systems, devices, and methods described herein will address at least some of the above concerns.

SUMMARY

Generally, a variety of devices and methods for reducing occlusion for an in-canal hearing device are provided in the present disclosure. In various embodiments, in situ adjustable venting via manual or automatic, for example, electronic means, will provide another powerful way to improve sound quality in real time.

According to some embodiments, the devices will generally comprise a gel (or a gel-filled bladder) or other malleable element or structure which is shaped to define one or more channels for ear canal venting when placed in the ear canal. The gel or other malleable element may be deformed to vary the size of the channel(s) and thereby the degree of venting provided. The degree of venting may be adjusted in response to a variety of cues such as for feedback or for the ambient acoustic environment. Also, the gel or other malleable element or structure may be soft and conformable such that placement in the sensitive, bony portion of the ear canal minimally irritates the tissue therein.

According to one aspect disclosed herein, an ear tip apparatus may comprise a malleable structure. The malleable structure may be sized and configured for placement in an ear canal of a user. For instance, the malleable structure may have a cross-section shaped to define at least one channel between an inner wall of the ear canal and an outer surface of the malleable structure for venting of the ear canal. The malleable structure may be deformable to adjust the cross-section thereof so as to vary a size of the at least one channel to adjust a degree of venting provided by the at least one channel.

In various embodiments, the ear tip apparatus may further comprise an actuator coupled to the malleable structure and operable to cause the malleable structure to deform. The actuator may comprise a slider configured for translation and/or rotation relative to the malleable structure. For example, the slider may comprise one or more threads to facilitate rotation relative to the malleable structure. Translating and/or rotating the slider toward the malleable structure may deform the malleable structure to increase the size of the at least one channel to reduce the degree of venting provided by the at least one channel. The actuator may further comprise an elongate element coupled to the malleable structure and the slider. The malleable structure may be disposed over the elongate element and the slider may be translatable over the elongate element. The elongate element may comprise one or more of a shaft, wire, or a post.

In various embodiments, the actuator may be configured to vary the degree of venting provided by the at least one channel in response to one or more of detected feedback or an environmental cue. The actuator may comprise one or more of a circuitry, a processor, or a mechanical element adapted to be responsive to one or more of the detected feedback or the environmental cue. The detected feedback or the environmental cue may be indicated from a sensor in communication with the actuator. The sensor may comprise one or more of a microphone, an accelerometer, a vibration sensor, an internal sensor of the ear tip apparatus, or a sensor of a control device external of the ear tip apparatus (e.g., a BTE unit). The communication may be at least partially electronic and/or wireless. The actuator may be configured to vary the degree of venting provided by the at least one channel in response to one or more of a volume or a sound directionality of an ambient environment. The actuator may be configured to increase the degree of venting in a loud ambient environment, thereby allowing the user to hear more unprocessed sound, or to decrease the degree of venting in a loud ambient environment, thereby allowing the user to hear more processed sound.

In various embodiments, the malleable structure may be deformable between a low cross-sectional area configuration and a high cross-sectional area configuration. The channel(s)

may provide more venting when the malleable structure is in the low cross-sectional area configuration than when in the high cross-sectional area configuration. The malleable structure may be biased to assume the low cross-sectional area configuration. The malleable structure may have one or more of a Y-shaped, X-shaped, or cross-shaped cross-section.

In various embodiments, the malleable structure may comprise a gel. The malleable structure may comprise in certain embodiments a fluid-filled bladder. The fluid-filled bladder may comprise a bladder wall and a bladder fluid, and the bladder wall may comprise one or more of a stiff plastic or an elastomeric material. The stiff plastic or elastomeric material may comprise one or more of silicone, parylene, nylon, a PEBA material, Pebax, or polyurethane. The bladder fluid may comprise one or more of a gas, a liquid, or a gel. The bladder fluid may comprise air or nitrogen. The gel may comprise one or more of a silicone gel, a viscous hydrophilic fluid, a viscous hydrophobic material, a thixotropic material, a viscoelastic material, a dilatant material, a rheopectic material, Nusil MED-6670, Nusil MED-6346, Nusil MED-6345, a polyurethane gel, a polyvinylpyrrolidone gel, a polyethylene glycol gel, glycerol, thickened glycerol, petroleum jelly, mineral oil, lanolin, silicone oil, or grease.

Typically, the ear tip apparatus is inserted into the ear canal as a stand-alone unit contacting the inner wall of the ear canal. In various embodiments, however, the ear tip apparatus may be provided as a component of a greater hearing device. This hearing device may comprise a body configured for placement within an ear canal of a user. The body may define an inner channel, and the ear tip apparatus may be placed within the inner channel of the body. The channel(s) may be defined between an inner wall of the body and an outer surface of the malleable structure of the ear tip.

According to another aspect disclosed herein, a method for reducing occlusion in a hearing device placed in an ear canal of a user may comprise a step of deforming a malleable structure placed in the ear canal. Such deformation may vary a size of at least one channel to adjust a degree of venting provided by the at least one channel. The malleable structure may be sized and configured for placement in the ear canal and may have a cross-section shaped to define the at least one channel between the inner wall of the ear canal and an outer surface of the malleable structure. The malleable structure may comprise a gel.

In various embodiments, the malleable structure is deformed by translating or rotating a slider relative to the malleable element. The slider may be translated or rotated over an element, wherein one or more of the slider or the malleable structure is disposed over the element. Translating and/or rotating the slider relative to the malleable structure may transition the malleable structure from a low cross-sectional area configuration to a high cross-sectional area configuration and/or move the slider toward the malleable structure.

In various embodiments, the method may further comprise a step of adjusting the degree of venting in response to one or more of detected feedback or an environmental cue. The detected feedback or the environmental cue may be indicated from a sensor. The sensor may comprise one or more of a microphone, an accelerometer, a vibration sensor, an internal sensor of the hearing device, or a sensor of a control device external of the hearing aid. The degree of venting may be increased in a loud ambient environment, thereby allowing the user to hear more unprocessed sound; or, the degree of venting may be decreased in a loud ambient environment, thereby allowing the user to hear more processed sound.

According to one aspect disclosed herein, a hearing device may comprise a body and first and second baffles. The body may be configured for placement within an ear canal of a user. The first and second baffles may each be coupled to the body and may each have at least one opening for venting of the ear canal. One or more of the first or second baffles may be rotatable relative to one another to vary the alignment of their openings with one another to adjust a degree of venting through the body of the hearing device. Each baffle may have a plurality of openings.

In various embodiments, the first and second baffles are rotatable to fully align the opening(s) of the first baffle and the opening(s) of the second baffle with one another to allow full venting through the aligned openings. The first and second baffles may be rotatable to misalign the opening(s) of the first baffle with the opening(s) of the second baffle such that no venting or a partial/reduced venting is allowed through the openings and baffles.

In various embodiments, the hearing device further comprises an actuator configured to vary the alignment of the opening(s) of the first baffle and the opening(s) of the second baffle with one another. The actuator may be configured to vary the alignment of the opening(s) of the first baffle and the opening(s) of the second baffle with one another in response to detected feedback or an environmental cue. The detected feedback or the environmental cue may be indicated from a sensor in communication with the actuator. The sensor may comprise one or more of a microphone, an accelerometer, a vibration sensor, an internal sensor of the hearing device, or a sensor of a control device external of the hearing device (e.g., a BTE unit). The actuator may be in electronic communication with the sensor. The actuator may be configured to vary the alignment of the opening(s) of the first baffle and the opening(s) of the second baffle with one another in response to one or more of a volume or a sound directionality of an ambient environment. The actuator may be configured to more closely align the opening(s) of the first baffle and the opening(s) of the second baffle with one another in a loud ambient environment, thereby allowing the user to hear more unprocessed sound; or the actuator may be configured to less closely align the opening(s) of the first baffle and the opening(s) of the second baffle with one another in a loud ambient environment, thereby allowing the user to hear more processed sound.

According to another aspect disclosed herein, an ear tip apparatus (e.g., hybrid ear tip) comprising a hard core and a gel portion is provided. The hard core may be configured for placement in an ear canal and may have a lateral portion and a medial portion. The gel portion is disposed over at least the medial portion of the hard core and configured to deform and conform to the ear canal.

In various embodiments, the medial portion is configured to conform to a cartilaginous portion of the ear canal.

In various embodiments, an exposed outer surface of the hard core is configured to end at a location of the ear tip apparatus configured to be placed at the isthmus of the ear canal when the ear tip apparatus is inserted in the ear canal.

In various embodiments, an outer surface of the gel portion may be configured or shaped to define one or more channels for venting of the ear canal.

In various embodiments, the ear tip apparatus further comprises one or more transducers for transmitting sound to the user. The one or more transducers may be housed within the hard core.

In various embodiments, the gel portion comprises one or more of a silicone gel, a viscous hydrophilic fluid, a viscous hydrophobic material, a thixotropic material, a viscoelastic material, a dilatant material, a rheopectic material, Nusil MED-6670, Nusil MED-6346, Nusil MED-6345, a polyurethane gel, a polyvinylpyrrolidone gel, a polyethylene glycol gel, glycerol, thickened glycerol, petroleum jelly, mineral oil, lanolin, silicone oil, or grease.

Other features and advantages of the devices and methodology of the present disclosure will become apparent from the following detailed description of one or more implementations when read in view of the accompanying figures. Neither this summary nor the following detailed description purports to define the invention. The invention is defined by the claims.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

It should be noted that the drawings are not to scale and are intended only as an aid in conjunction with the explanations in the following detailed description. In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings. A better understanding of the features and advantages of the present disclosure will be obtained by reference to the following detailed description that sets forth illustrative embodiments, in which the principles of the disclosure are utilized, and the accompanying drawings of which.

DETAILED DESCRIPTION

In the following detailed description, reference is made to the accompanying drawings that show, by way of illustration, some examples of embodiments in which the disclosure may be practiced. In this regard, directional terminology, such as "right", "left", "upwards", "downwards", "vertical", "horizontal" etc., are used with reference to the orientation of the figure(s) being described. Because components or embodiments of the present disclosure can be positioned or operated in a number of different orientations, the directional terminology is used for purposes of illustration and is in no way limiting. It is to be understood that other embodiments may be utilized and structural or logical changes may be made without departing from the scope of the present disclosure.

The term "gel" as used herein refers to any number of materials that are soft and viscoelastic. The mechanical properties of a "gel" as used herein may range from a viscous liquid such as honey or mineral oil to a soft elastic solid, such as gelatin. For example, a "gel" may comprise a soft, weakly cross-linked solid that can deform and flow under applied force and may spring back slowly upon removal of the applied force. One example is Nusil MED-6346 silicone gel. The "gels" of the present disclosure may be homogenous or heterogeneous (as in slurries, colloids, and emulsions). The "gels" of the present disclosure may be hydrophobic or hydrophilic. Heterogeneous gels may include different phases that have different solubility and transport properties; for example, a hydrophobic, contiguous, soft polymer filled partially with particles of hydrophilic polymers. Such a composite material may accrue performance advantages from each material, such as elasticity, chemical resistance, and moisture transport. The "gels" of the present disclosure may include any low-shear modulus material based on chemistries such as silicone, polyurethane, polyvinylpyrrolidone, and polyethylene glycol. The "gels" of the present disclosure may also include foam materials such as those made of silicone, polyurethane, or the like and/or foam materials impregnated with liquids or gels. Additional examples of "gels" are further described below in reference to various embodiments.

The terms "operatively connected," "coupled," or "mounted," or "attached" as used herein, means directly or indirectly coupled, attached, or mounted through one or more intervening components.

Figure 1:
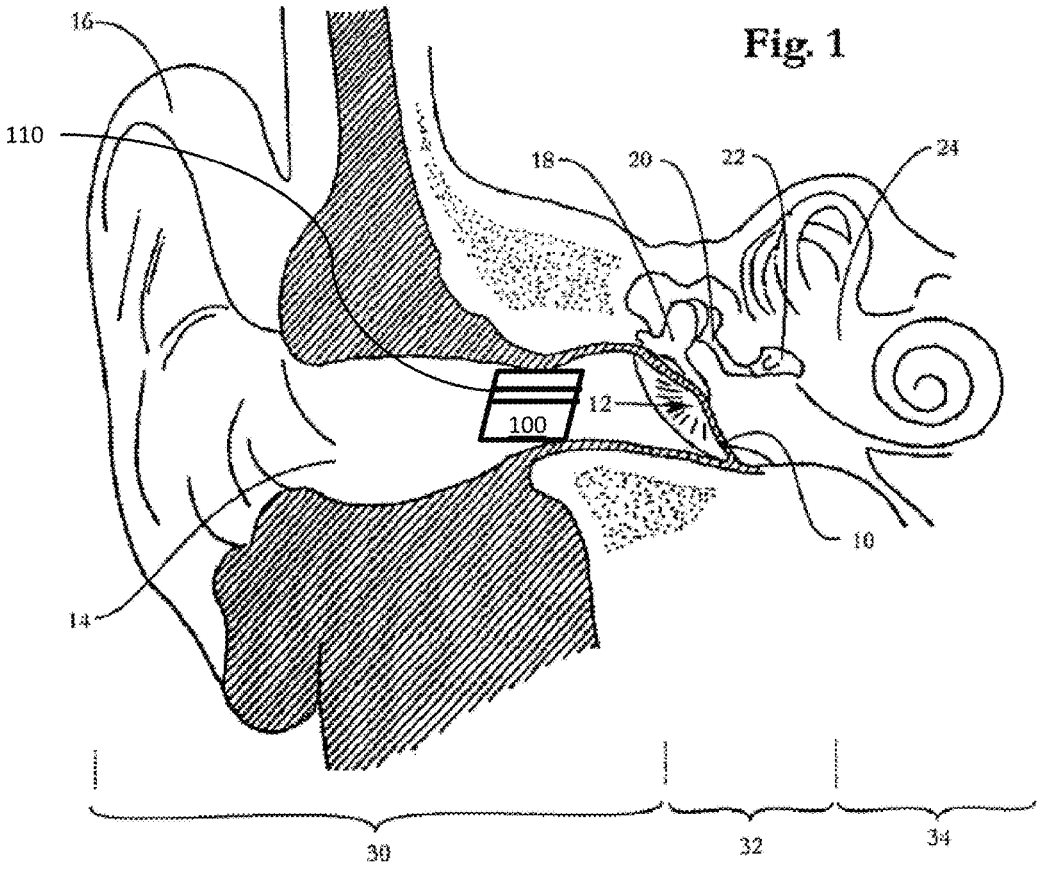
FIG. 1 is a section view of a hearing instrument or ear tip placed within the ear canal of a human ear, according to some embodiments.

FIG. 1 shows a cross sectional view of outer ear 30, middle ear 32 and inner ear 34 (part). The outer ear comprises primarily of the pinna 16 and the ear canal 14. The middle ear is bounded by the tympanic membrane (ear drum) 10 on one side, and contains a series of three tiny interconnected bones: the malleus (hammer) 18; the incus (anvil) 20; and the stapes (stirrup) 22. Collectively, these three bones are known as the ossicles or the ossicular chain. The malleus is attached to the tympanic membrane 10 while the stapes, the last bone in the ossicular chain, is coupled to the cochlea 24 of the inner ear.

Many hearing instruments or hearing aids include "ear tips" that fit inside the external auditory canal or ear canal 14 to deliver sound to the eardrum or tympanic membrane 10. Ear tips are support structures that suspend and retain a sound tube or receiver inside the ear canal. A sound tube, for example, may be a hollow plastic tube that guides sound generated in an external hearing instrument, while a receiver is a miniature speaker that is connected to an external hearing instrument via wires. To minimize occlusion, such ear tips generally provide venting through the ear canal through an opening, channel, or vent along its length. As discussed above, many current ear tips have fixed vent sizes that may limit their effectiveness. Another types of hearing instruments, for example, completely-in-canal (CIC) hearing instruments could also benefit from adjustable venting.

As shown in FIG. 1, a hearing device or ear tip 100 may be placed within the ear canal 14, for example, between the lateral cartilaginous part and the medial body part. The hearing device 100 may include one or more openings, channels, or vents 110 to allow the ear canal 14 to vent.

Figure 2A:
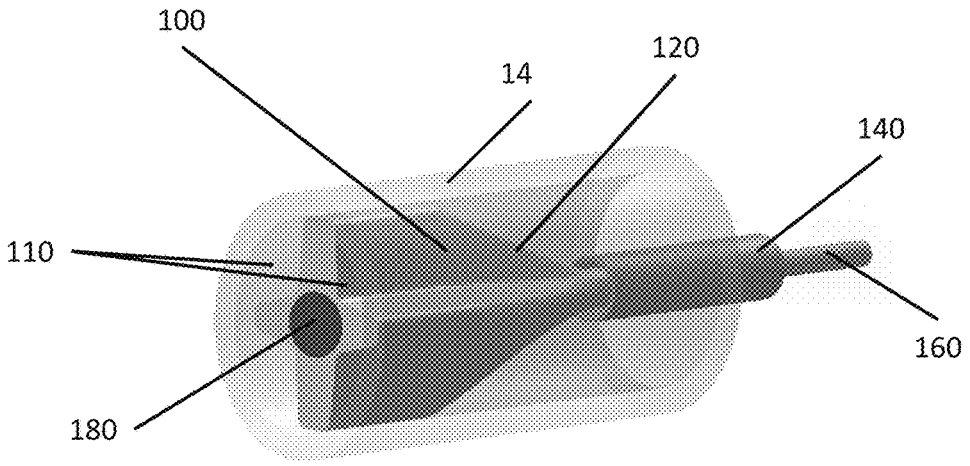
FIGS. 2A and 2B are examples of perspective views of an ear tip in a high venting configuration (FIG. 2A) and a low venting configuration (FIG. 2B) placed within the ear canal, according to some embodiments.
Figure 2B:
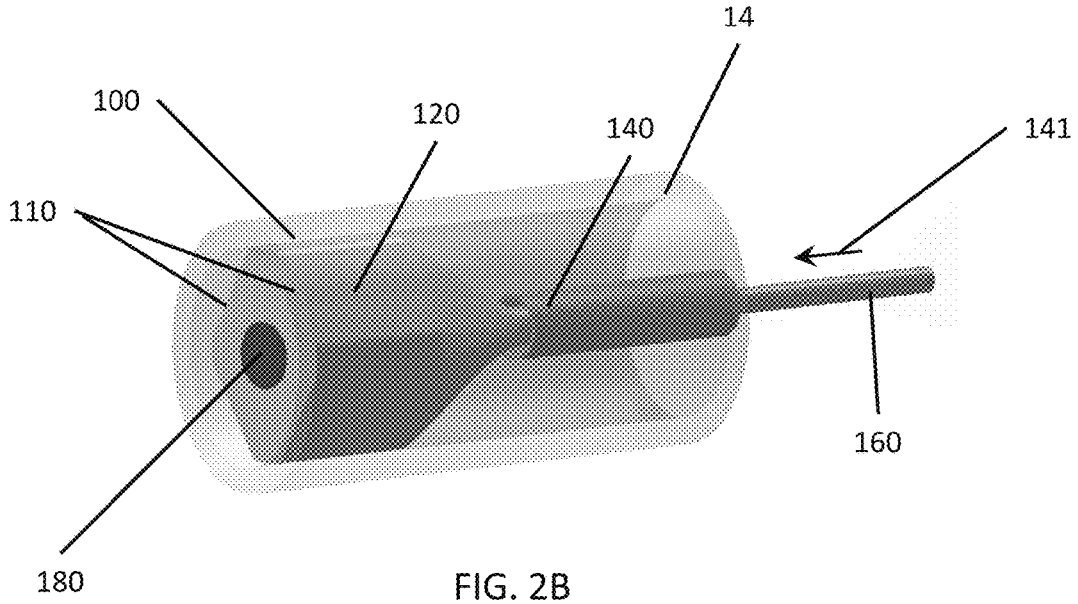

FIGS. 2A and 2B show the hearing device 100 in place in the ear canal 14. FIG. 2A shows the hearing device 100 in a low cross-sectional area, high venting configuration. FIG. 2B shows the hearing device 100 in a high cross-sectional area, low venting configuration. The hearing device or ear tip 100 may comprise a malleable element or structure 120, a slider 140, and an element 160. The hearing device 100 may also comprise an output transducer 180. For example, the output transducer 180 may comprise a laser photodiode or other emitter for emitting an optical signal to be received by a device placed on the tympanic membrane 10 such as the Contact Hearing Device available from EarLens Corporation of Menlo Park, Calif. Systems and methods for photomechanical hearing transduction are also described in co-assigned U.S. Pat. Nos. 7,668,325, 7,867,160, 8,396,239, 8,696,541, 8,715,152, 8,824,715, and 8,858,419, the full contents of which are incorporated herein by reference. In further examples and embodiments, the output transducer may comprise a miniature speaker or receiver.

Figure 5A:
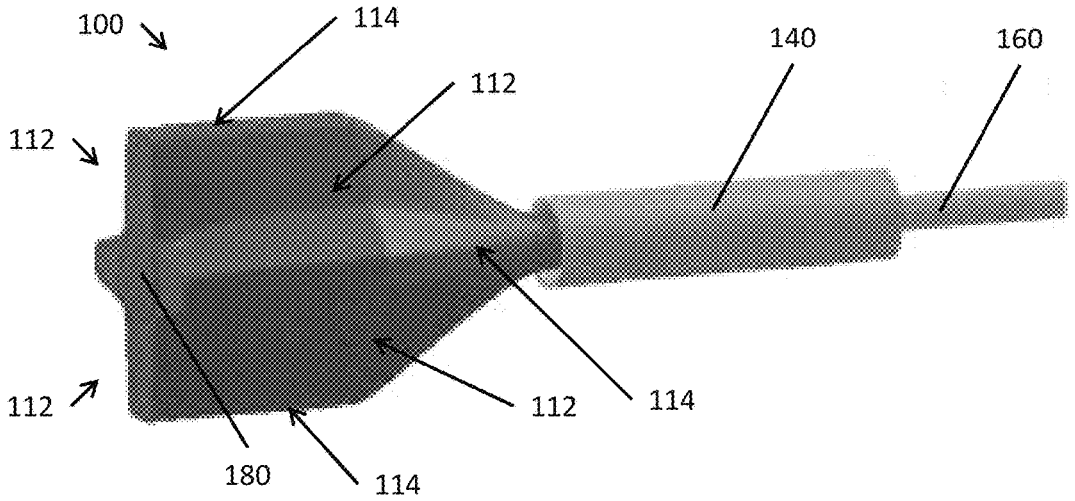
FIG. 5A is a perspective view of an example of the ear tip in the high venting configuration, according to some embodiments.
Figure 5B:
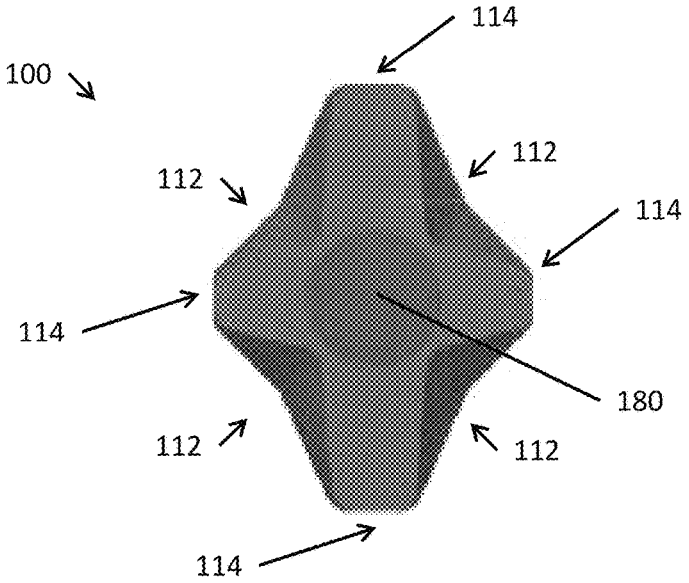
FIG. 5B is a front view of the ear tip adjusted to the high venting configuration, according to some embodiments.

The malleable element 120 may be conically shaped. The malleable element 120 may have a distal or medial portion adapted or configured to be in contact with and be flush with the inner wall of the ear canal 14 and a tapered proximal or lateral portion. The malleable element 120 in the low cross-sectional area, high venting configuration may be shaped to define one or more channels 110. In one example shown in FIG. 2A, the malleable element 120 has a cross-shaped cross-section to define four channels 110 between the outer surface of the malleable element and the inner wall of the ear canal 14. The cross-shaped cross-section further defines four ear canal wall contacting extensions 114 as shown in FIGS. 5A, 5B. The malleable element 120 may also have other cross-sectional shapes, such be I-shaped, Y-shaped, or X-shaped, or have a plurality of channels 110, to name a few. While the malleable element 120 is shown and described as being configured to be in contact with the inner wall of the ear canal 14, in some embodiments, the malleable element 120 may be housed, for example, in a shell, housing or other device body that may be molded to fit within the ear canal.

Figure 3A:
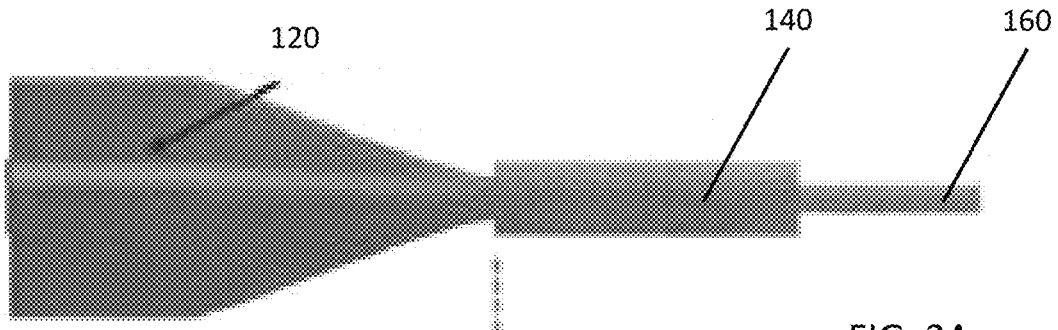
FIGS. 3A and 3B are side views of the ear tip of FIG. 2A in the high venting configuration (FIG. 3A) and the low venting configuration (FIG. 3B), according to some embodiments.
Figure 3B:
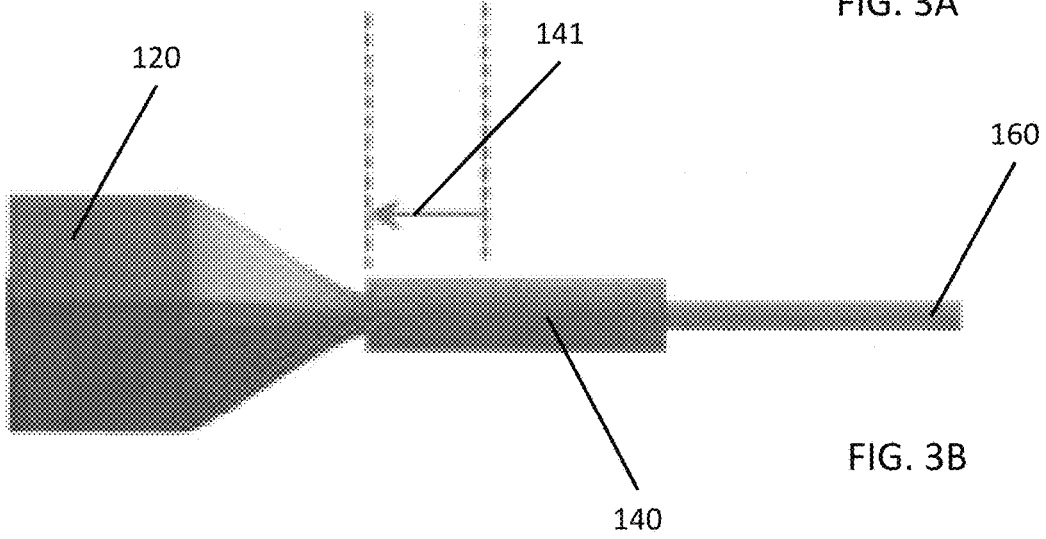
Figure 4A:
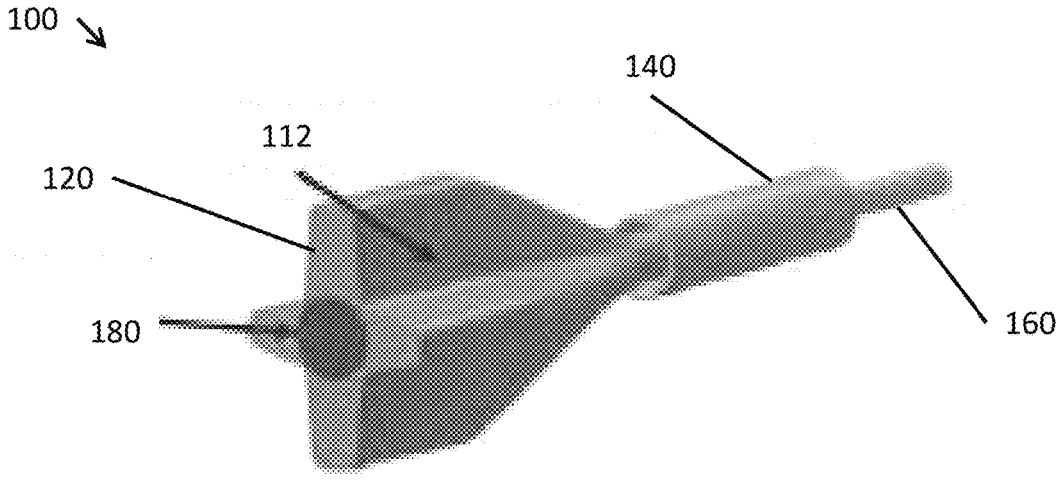
FIGS. 4A and 4B are perspective views of the ear tip of FIG. 2A in the high venting configuration (FIG. 4A) and the low venting configuration (FIG. 4B), according to some embodiments.
Figure 4B:
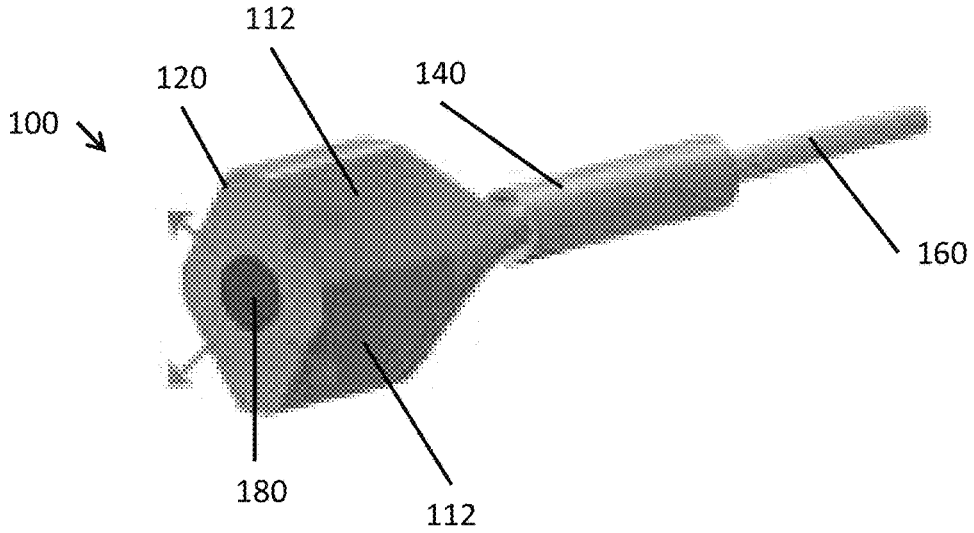

FIGS. 3A and 3B show side views of an example of the transition of the ear tip 100 from the low cross-sectional area, high venting configuration, shown by FIG. 3A, to the high cross-sectional area, low venting configuration, shown by FIG. 3B. In this example the slider 140 may be advanced toward the malleable element 120 (or toward the tympanic membrane 10) over the element 160 (for example, a wire or a shaft) as shown by arrow 141 in FIGS. 2B and 3B. As a result, the material of the malleable element 120, for example gel, is then urged radially outward to decrease the cross-sectional area of the channels 110. In particular, relief or "cut-away" areas 112 (shown, for example, in FIGS. 4A and 4B) which in part define the channels 110 may bulge outwardly. FIGS. 5A and 5B show a perspective view and a front view of the ear tip 100 and the relief or "cut away" areas 112.

Figure 6:
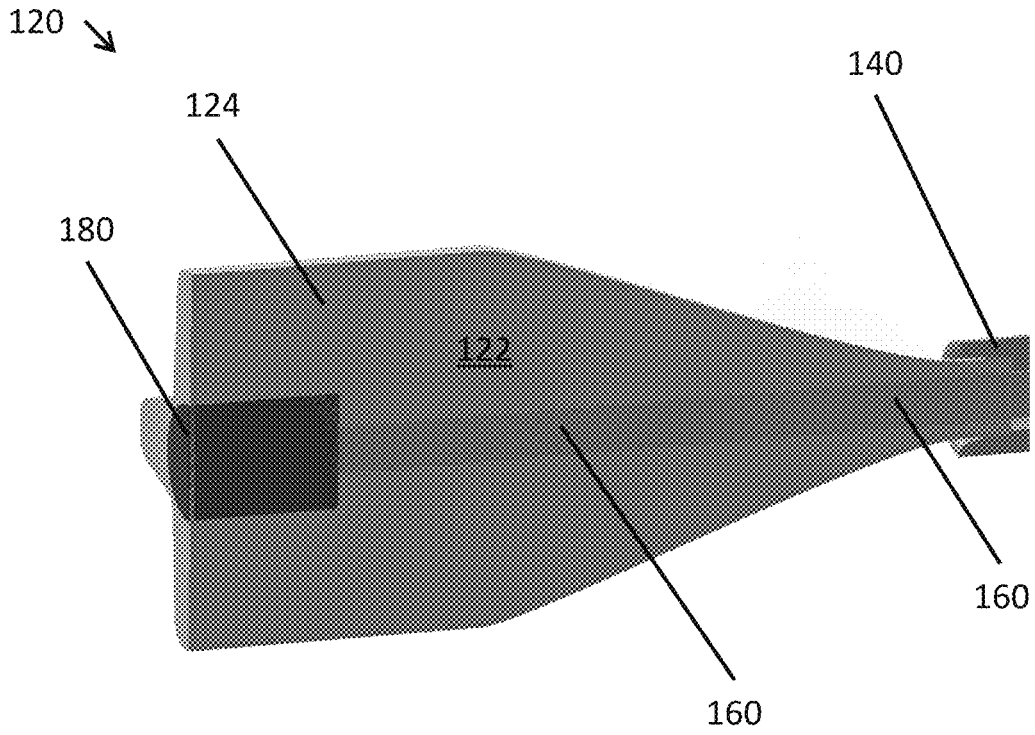
FIG. 6 shows a section view of another example of the ear tip in the high venting configuration, according to some embodiments.

FIG. 6 shows an alternative embodiment of the malleable element 120. In this embodiment, the malleable element 120 comprises a gel or fluid 122 surrounded by a thin bladder 124. In various embodiments, the malleable element 120 may be biased to assume the low cross-sectional area, high venting configuration. The malleable element 120 may be disposed radially over the element 160. Advancing the slider 140 in the distal or medial direction may squeeze the bladder 124 to force the gel 122 radially outward. The slider 140 may be movable continuously toward or away from the malleable element 120. Alternatively or in combination, the slider 140 may be movable between a plurality of discrete locations toward or away from the malleable element 120 to achieve specific size and/or configuration of the channels 110. The output transducer 180 may be coupled, for example, to distal ends of the element 160 and the malleable element 120. The element 160 may comprise a shaft, a post, or a wire, to name a few exemplary structures. In some embodiments, the element 160 may be elongated and may comprise a shaft and/or one or more wires to provide power and/or signals to the output transducer 180.

The gel 122 may be comprised of one or more of a silicone gel, a viscous hydrophilic fluid, a viscous hydrophobic material, or a gas, to name a few. Examples of silicone gels that may be used as the gel or fluid 122 include NuSil MED-6670, NuSil MED-6346, and NuSil MED-6345, available from NuSil Technology LLC of Carpintera, Calif., and polyurethanes, to name a few. Examples of viscous hydrophilic fluids that may be used as the gel 122 include glycerol and glycerol thickened with thickening agents such as carbopol, polyvinylprolidone, poly (ethylene glycol), etc., to name a few. Examples of viscous hydrophobic materials that may be used as the gel or fluid 122 include petroleum jelly, mineral oil, lanolin, silicone oils, and grease, to name a few. Examples of gases which may be used as the gel or fluid 122 include air or nitrogen. Examples of other filler materials that may be used as the gel or fluid 122 include viscous fluids and viscoelastic materials (including thixotropic and dilitant), to name a few.

In some embodiments, the malleable element 120 comprises the gel 122 without the thin bladder 124. In such embodiments, the gel or 122 may comprise a soft elastic or viscoelastic (including solid) material.

The thin bladder 124 may have different thickness and/or stiffness in some areas versus others. For example, the relief or "cut away" areas 112, as shown by FIGS. 5A and 5B, may be more elastic than the contact areas 114 which are configured to contact the inner wall of the ear canal 14. The thin bladder 124 may be comprised of a stiff plastic or an elastomeric material. Examples of stiff plastics include parylene, nylon, PEBA materials (such as Pebax), and polyurethane, to name a few. Examples of elastomeric materials include silicone, polyurethane, PEBA, and nylon, to name a few.

The outer surface of the malleable element 120, including the outer surface of the thin bladder 124, may be amenable to sliding, for example, by the exemplary slider 140. To be amenable to sliding, the outer surface of the malleable element 120 may have medium to low friction and little or no track.

In some embodiments, the element 160 may extend laterally or proximally to connect to an external support unit. The external support unit may be a device or an apparatus placed in the ear canal, within the pinna, or behind-the-ear (BTE). The external support unit may comprise components such as a microphone to capture sound, a signal processor to process the captured sound, a power source such as a battery, a sensor, a receiver and/or transmitter to receive/transmit signals or instructions from another internal device, and/or an actuator to operate the slider 140. The sensor may comprise an accelerometer to capture movement and directionality, a thermometer to measure temperature, or a humidity sensor, to name a few. Such sensors may be in communication with the actuator, such as through a wired or a wireless connection. The actuator may comprise a mechanical and/or electrical actuator to operate the slider 140 and vary the venting provided by the malleable element 120. The actuator may be a component of the ear tip 100 in at least some embodiments and applications.

The slider 140 that is used to deform the malleable element 120 of the ear tip 110 is shown just as an example only, and many other appropriate means and mechanisms for actuating, deforming or changing the shape and configuration of the malleable element to adjust the venting is within the scope of the present disclosure. For example, in some embodiments, an electromechanical actuator may be configured to draw low amounts of power and/or consume low or no power to hold a given position or degree of venting. In some embodiments, the actuator may comprise a ratcheting mechanism with a plunger motion such as a solenoid. The ratcheting mechanism may be linear and/or rotational with a screw drive. In some embodiments, the actuator may comprise a pump to pressurize the fluid or gel 122 (for example, within the bladder 124 for those embodiments that comprise such bladder) to change the shape of the malleable element 120. In some embodiments, an electric field may be used to change the size or shape of the gel 122, and therefore, the malleable element.

The actuator may be manually operated (such as by the user, the wearer, and/or a medical professional) or may operate automatically in response to programming, for example, to vary the venting provided based on sensor input. For example, the actuator may be placed in communication with an application loaded on a user-operated mobile computing device such as a smartphone, tablet computer, laptop computer, or the like to operate the slider 140 or any other alternative mechanism. Alternatively or in combination, the user may operate the slider 140 or other appropriate mechanism by hand or with a handheld tool.

The actuator may be responsive to a variety of cues to vary the venting provided by the malleable element 120. Generally, these cues may be environmental or indicative of feedback which may occur when an excess of ear canal venting is provided. The cue may be provided, for example, from a sensor of the hearing aid or ear tip 100 and/or from a sensor of the external support unit such as a BTE unit. For example, the degree of venting provided may be varied in response to the volume of the ambient environment or direction of origin of certain sounds. The degree of venting in a loud ambient environment, for instance, may cause venting to increase to allow the user to hear more unprocessed sound or to decrease to allow the user to hear more processed sound. Further non-limiting examples are as follows.

Feedback may be sensed and the degree of venting provided may be varied to suppress feedback. For example, the ear tip 100 may be in communication with a BTE unit. The microphone of the BTE unit may be used to detect feedback. Feedback may be detected in many ways. Feedback may be detected by detecting a sound signature such as a narrow-band, high frequency sound (e.g., "whistling") or a loudness greater than the ambient sound level, for example. Feedback may be detected based on sound directionality, such as sound detected as emanating from the ear canal. This directionality may be detected based on the phase difference between microphones (e.g., between a first microphone placed in the ear canal and a second microphone of the BTE unit) and/or the amplitude or loudness of the sound (e.g., absolute amplitude and/or the difference in amplitude detected between different microphones). Feedback may be detected, for example, with a sensor on the ear tip 100. Such sensors may comprise a microphone, an accelerometer to detect vibration associated with high-intensity sound, or a vibrational spectrometer (e.g., MEMS-based), to name a few. Feedback may be detected based on the drive state of internal electronics or circuitry of the ear tip 100. For example, the internal electronics or circuitry may detect when amplifier output is saturating in a given frequency band, which may indicate overdrive and a possible feedback state. Alternatively or in combination, the internal electronics or circuitry may detect when harmonic distortion becomes excessive, which may indicate clipping and feedback.

The ambient acoustic environment may be sensed and the degree of venting provided may be varied accordingly. A loud environment may trigger, for example, increased venting so that the wearer can hear more of the unamplified or unprocessed sound directly or decrease venting to attenuate ambient sounds such that the ear tip 100 can deliver "selective" sound the user may prefer. Such "selective" sound may comprise, for example, the streaming of a telephone call or music from an external computing device such as a smart phone, tablet computer, personal computer, music player, media player, or the like. Other examples include sound from a directional microphone or a microphone array which may be beam forming. In some embodiments, the "selective" sound may be selected using an application loaded onto a computing device. The selection may be based on user settings adjustable in real time or based on chosen profiles that are stored and activated automatically or manually. For example, a profile may be chosen to be more appropriate for quiet environments. This quiet environment profile may trigger increased venting so that the user or wearer of the ear tip 100 may hear more clearly in a one-on-one conversation by taking advantage of the natural directional response of the pinna. Sensing of the acoustic environment can be performed in many ways, including without limitation, by local hearing instrument electronics such as of the ear tip 100 or an associated external unit, by a computing device in communication with the former, or by another server device such as a personal computer.

Figure 7A:
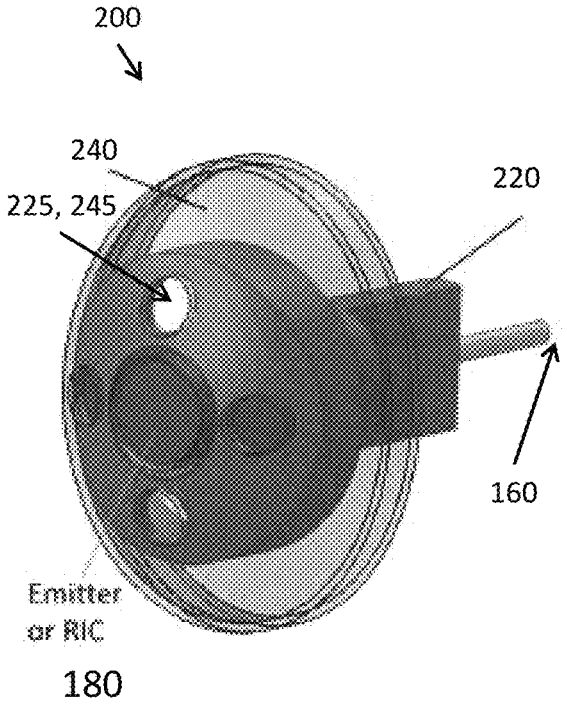
FIG. 7A shows a perspective front view of yet another example of a double-baffled ear tip in a high venting configuration, according to some embodiments.
Figure 7B:
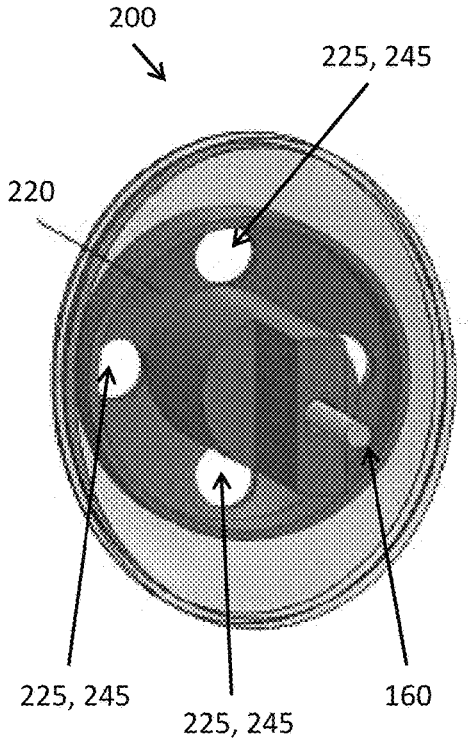
FIG. 7B shows a perspective view of the back of the ear tip of FIG. 7A, according to some embodiments.

According to another aspect of the present disclosure, FIGS. 7A and 7B show an alternative hearing device or ear tip 200 with adjustable venting. The ear tip 200 may comprise a proximal baffle 220 and a distal baffle or tip 240. The proximal baffle 220 may have one or more openings 225 to provide ear canal venting, and the distal baffle 240 may have one or more openings 245 to provide ear canal venting. The proximal and distal baffles 220, 240 may be coaxial and, either one or both, may be rotatable relative to one another to vary the alignment of the openings 225, 245. As shown in FIGS. 7A and 7B, the openings 225, 245 are fully aligned to provide the maximum degree of venting. The distal baffle 240 may be elastomeric and flexible to be seated within the ear canal 14. The proximal and distal baffles 220, 240 may be disposed over an element 160. The ear tip 200 may further comprise the output transducer 180 disposed on a distal tip of the distal baffle 240.

Figure 8A:
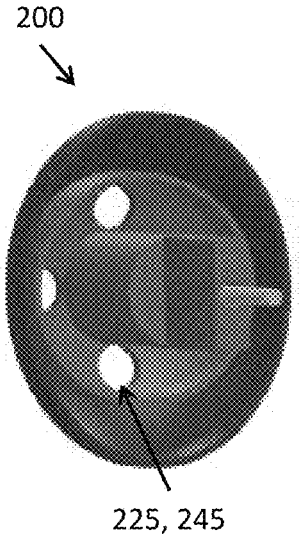
FIGS. 8A, 8B, and 8C show perspective views of the back of the ear tip of FIG. 7A as the ear tip is transitioned from the high venting configuration (FIG. 8A) to a low venting configuration (FIG. 8B) to a no venting configuration (FIG. 8C), according to some embodiments.
Figure 8B:
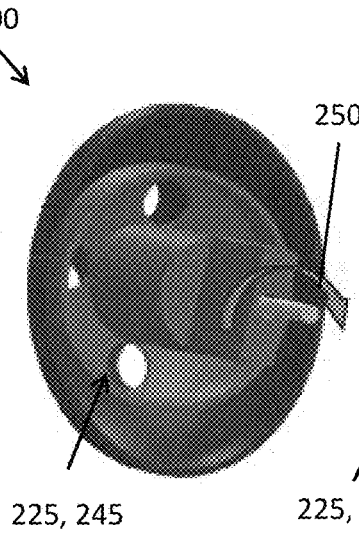
Figure 8C:
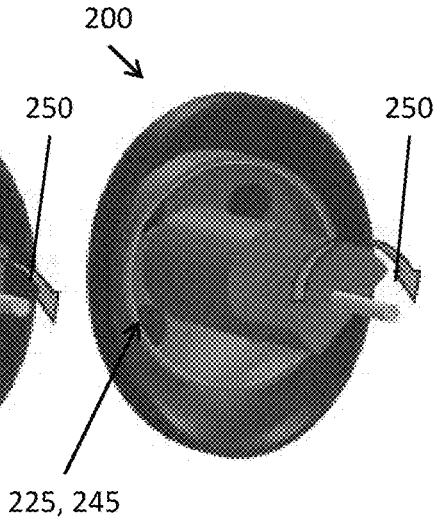

FIGS. 8A to 8C show the operation of the ear tip 200. FIG. 8A shows the ear tip 200 in a configuration to provide maximum venting by fully aligning the openings 225, 245 with one another. As shown in FIGS. 8B and 8C, the proximal baffle 220 may be rotated, for example, in a direction indicated by the arrow 250 to misalign the openings 225, 245 to reduce the degree of venting provided. FIG. 8B shows the ear tip 200 having the proximal baffle 220 rotated to be in an intermediate configuration with less venting. Here, the surfaces of the baffles 220, 240 partially cover the openings 225, 245. FIG. 8C shows the ear tip 200 having the proximal baffle 240 rotated to be in the completely closed configuration with no venting. Here, the surfaces of the baffles 220, 240 fully cover the openings 225, 245.

Figures 9A, 9B:
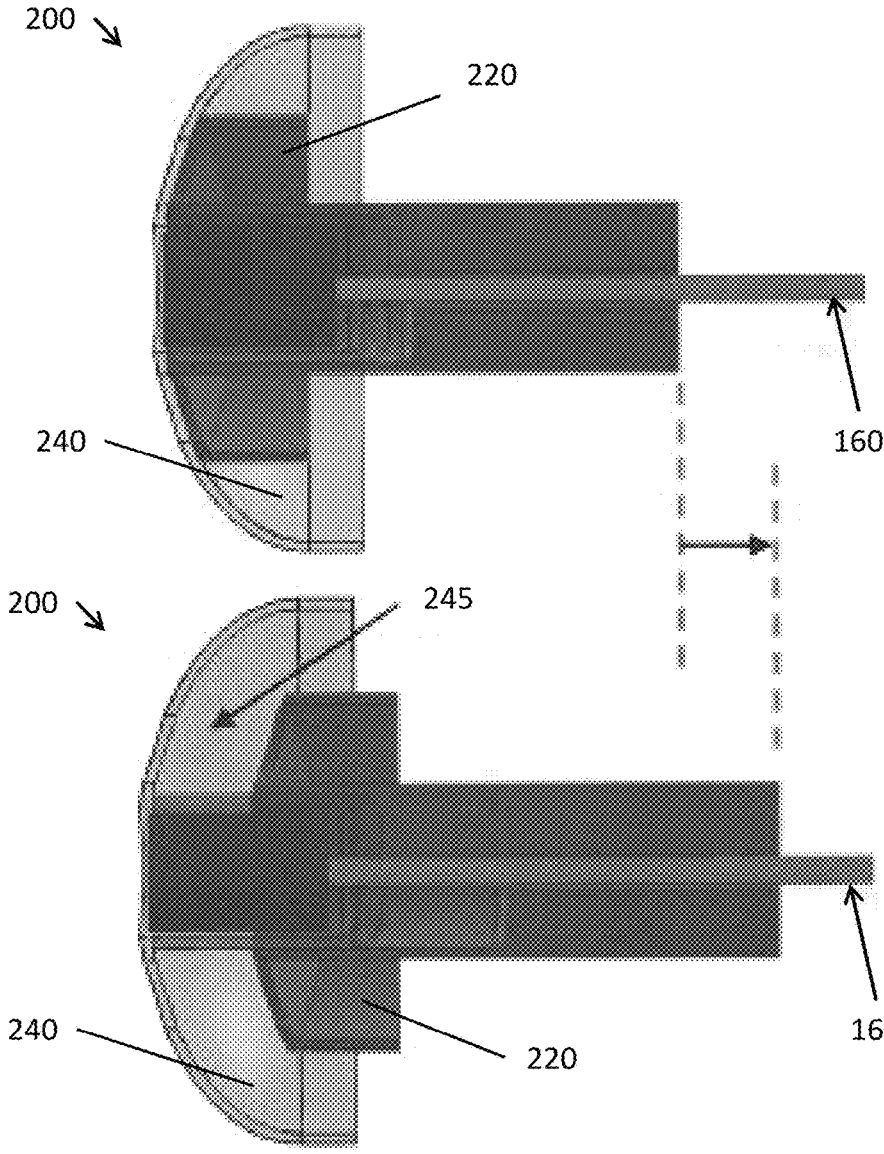
FIGS. 9A and 9B show section views of a double-baffled ear tip with baffle(s) translated to adjust venting from a minimal venting configuration (FIG. 9A) to a high venting configuration (FIG. 9B), according to some embodiments.

As shown in FIGS. 9A to 9B, the ear tip 200 may alternatively or in combination be configured to vary venting by translation of the baffles 220, 240. For example, the distal baffle 240 may have one or more openings 245 while the proximal baffle 220 may have no openings. The proximal baffle 220 may be advanced to contact the distal baffle 220 to close off venting as shown in FIG. 9A. The proximal baffle 220 may be retracted to allow access to the opening 245 to provide venting as shown in FIG. 9B. In some embodiments, the element 160 may include screw threads so that rotation of the proximal baffle 220 may translate into medial-lateral movement of the proximal baffle 220.

The ear tip 200 may be operated manually or automatically similarly to the ear tip 100 described above. The degree of venting provided by the ear tip 200 may be varied in response to a variety of cues similarly to the ear tip 100 above. For instance, the ear tip 200 may be coupled to an actuator and/or sensor(s), or a processor to vary the degree of venting provided in response to various cues.

According to yet another aspect, the present disclosure further provides for alternative improved ear tips that conform to anatomy, as described below. Such ear tips may be used in various applications and implementations, for example, to suspend or retain output transducers such as a laser photodiode or other emitter for emitting an optical signal to be received by a device placed on the tympanic membrane 10.

Many currently used ear tips are made of a rigid plastic that is generally custom-shaped to the wearer's ear canal. These ear tips typically fit in the cartilaginous portion of the ear canal and are usually oversized such that the soft tissue in this region can stretch and conform to the ear tip to improve retention and sealing. Such soft tissue stretching, however, can cause discomfort in the short term and permanent tissue deformation in the long term.

Figures 10A, 10B:
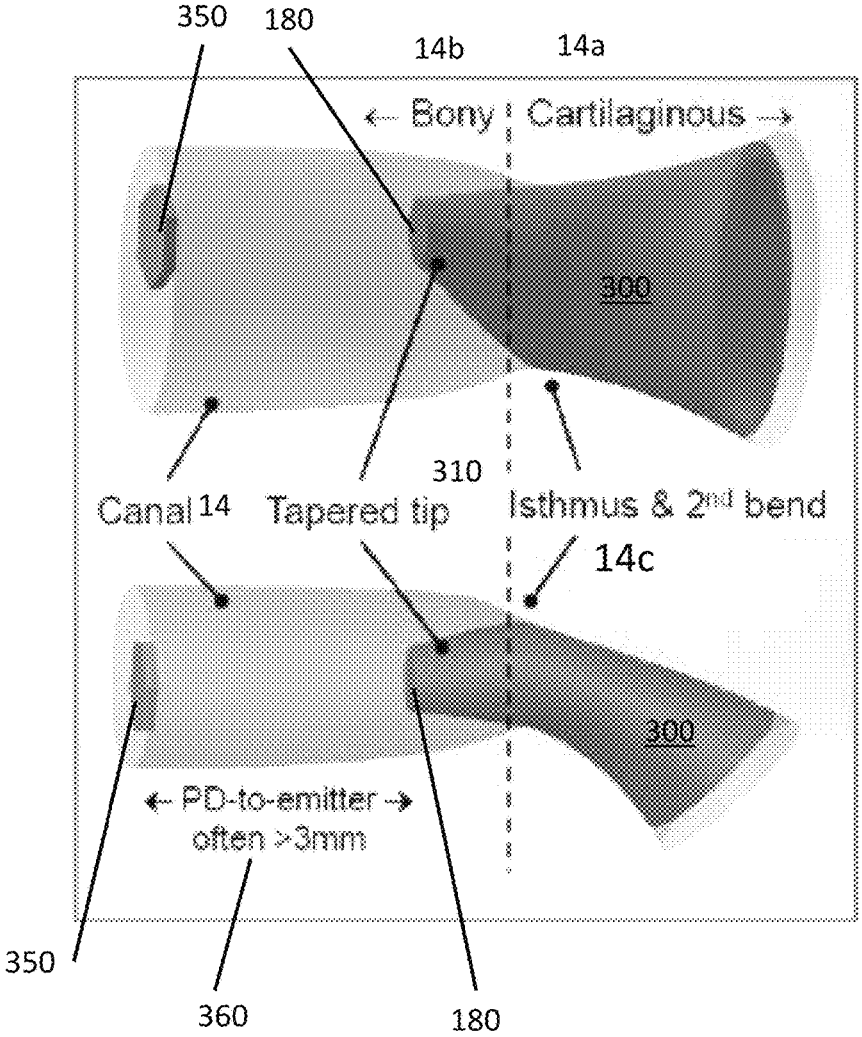
FIGS. 10A and 10B show side views of known rigid ear tips placed in the ear canal.

FIGS. 10A and 10B show an example of such known rigid ear tips 300 configured to be placed in the ear canal 14. The ear tip 300 is typically oversized at the cartilaginous portion 14*a* of the ear canal 14 before transitioning into a tapered tip 310 to be positioned at the bony portion 14*b* of the ear canal 14. The transition may be at the isthmus or second bend 14*c* of the ear canal 14. Most ear canals 14 will have a narrowing at the isthmus 14*c* located just lateral to the beginning of the bony canal 14*b*. The ear tip 300 may further comprise an output transducer 180 located at the distal or medial end of the ear tip 300.

In at least some cases, a tympanic membrane receiver 350 to receive power and/or signal from an optical signal, such as the Contact Hearing Device available from EarLens Corporation of Menlo Park, Calif., may require the photodiode or other output transducer 180 to be close and well-aligned with the receiver 350 to ensure good power transfer and optimal battery life. For example, the output transducer 180 may be positioned at a distance 360, for example, of approximately 3 mm away from the receiver 350 as shown in FIG. 10B. For the photodiode or other output transducer 180 to be positioned at this distance 360, the photodiode or other output transducer 180 will typically be located on the medial end of the ear tip located in the bony portion 14*b* of the ear canal 14. The tissue in the bony region is very thin (generally 0.1 to 0.2 mm) and sensitive. Pressure applied to the thin tissue should be less than about 20 mmHg to prevent capillary collapse and wound generation. The tissue in the bony region cannot conform to a rigid ear tip since it is surrounded by bone. Indeed, a rigid ear tip should not touch the tissue at all because of the high risk of generating "hot spots," local regions of high pressure, and wounds, since the soft tissue cannot conform.

Figures 11A, 11B, 11C:
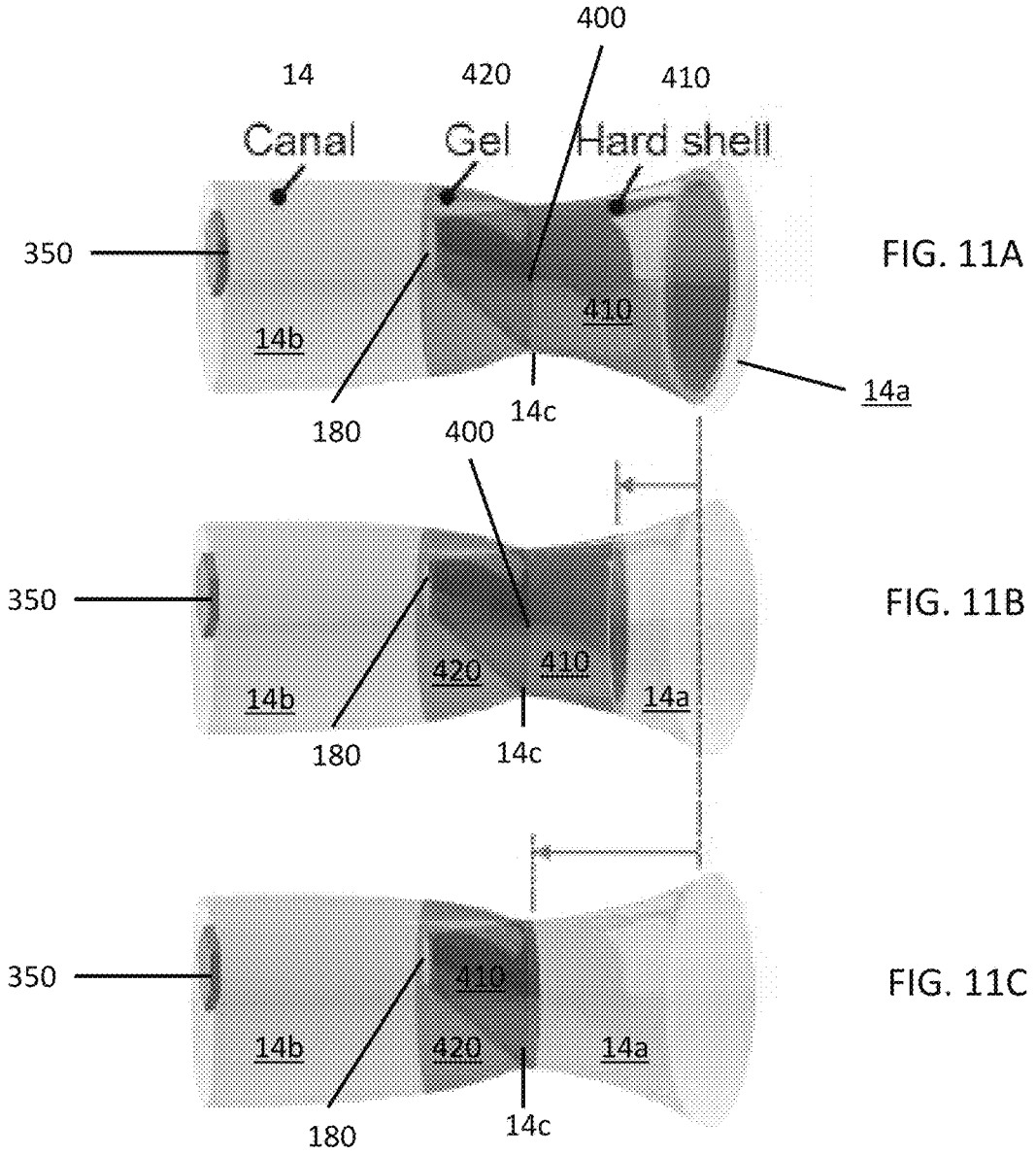
FIGS. 11A, 11B, and 11C show side views of examples of hybrid ear tips having a gel portion surrounding a hard core or shell and being placed in the ear canal, according to some embodiments.

To address at least this concern, ear tips of the present disclosure may be configured to conform to the anatomy with low wall pressure. FIGS. 11A, 11B, and 11C show ear tips 400 according to the present disclosure. The ear tips 400 are shown as placed in the ear canal 14 at one or more of the cartilaginous portion 14*a* or the bony portion 14*b*. The ear tips 400 may conform to the deep, bony ear canal 14*b* to provide alignment with the receiver 350 and retention while maintaining low wall pressure to support ear health and prevent pressure sores.

The ear tips 400 may be referred to as hybrid ear tips as they comprise a hard shell or core 410 and a gel portion 420 disposed over at least the distal or medial tip of the hard shell 410. As shown in FIGS. 11A and 11B, the hard core 410 may conform to the cartilaginous portion 14*a* of the ear canal 14.

The hard shell or core 410 may be substantially rigid and may be longer as in FIG. 11A, or shorter as in FIG. 11B. As shown in FIG. 11C, the hard shell 410 may be entirely housed within the gel portion 420 to be placed within the bony portion 14*b* of the ear canal 14. In some embodiments, an exposed outer surface of the hard core or shell 410 may have a length such that the hard core does not extend past an isthmus of the ear canal when the ear tip apparatus is inserted in the ear canal, as seen, for example, in FIGS. 11A-C. The gel of the gel portion 420 may comprise any of the gels described herein. The gel of the gel portion 420 may flow and conform to the bony portion 14*b* of the ear canal. The gel of the gel portion 420 may provide low, uniform hydrostatic pressure to all parts of the canal 14 with little to no "hot spots," or regions of high pressure. The gel portion 420 may provide gentle wall pressure for comfort (e.g., less than 20 mmHg) and ear health. In some embodiments, a membrane or a bladder can be used to surround and retain the gel as described in reference to the malleable element or malleable structure 120 above, particularly in cases where the gel may not be able to retain its own shape. Providing a surrounding membrane or bladder may also provide lubricity and/or some restoring force to help a soft gel fill and conform. The ear tips 400 may also provide mechanical retention via the isthmus 14*c*. The gel portion 420 of the ear tips 400 may deform to ease the insertion of the ear tips 400 past the narrowing at the isthmus 14*c*, and then widen back (e.g., return to its pre-biased or natural wider configuration) to provide gentle retention in the bony portion 14*b* of the ear canal. As shown in FIGS. 11A and 11B, the hard shell 410 may be oversized so that only its tapered tip can be advanced past the isthmus 14*c* and that the hard shell 410 is well seated in the cartilaginous portion 14*a* of the ear canal 14. The ear tips 400 may comprise the output transducer 180 positioned at the distal end of the hard shell 410.

Figure 12A:
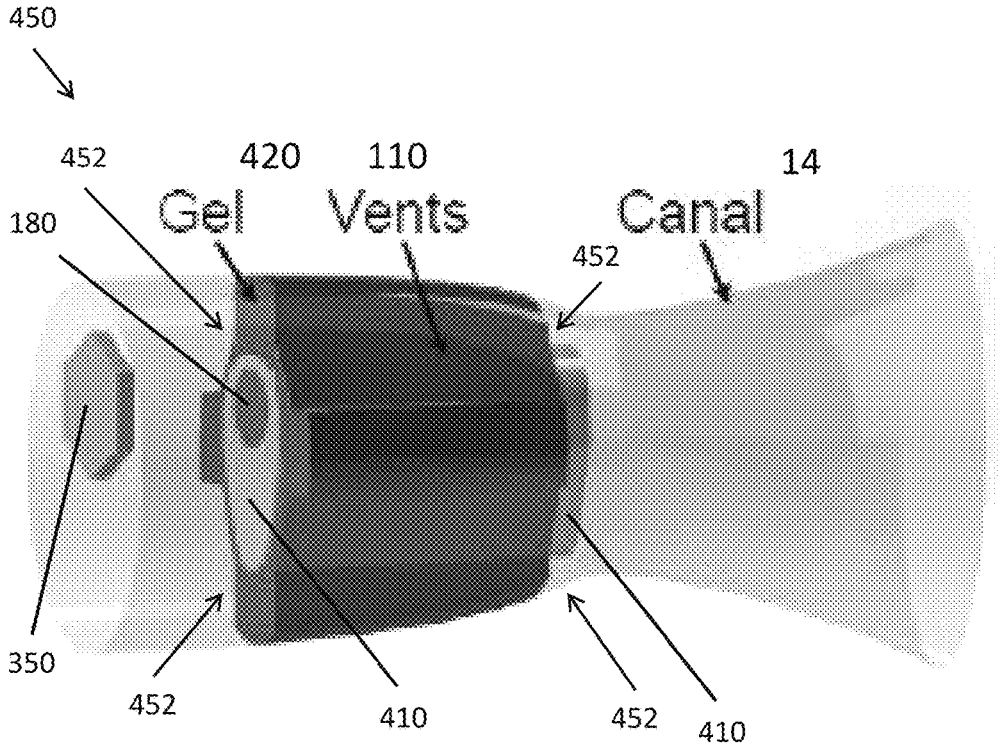
FIG. 12A shows a perspective view of a hybrid ear tip placed in the ear canal, according to some embodiments.
Figures 12B, 12C:
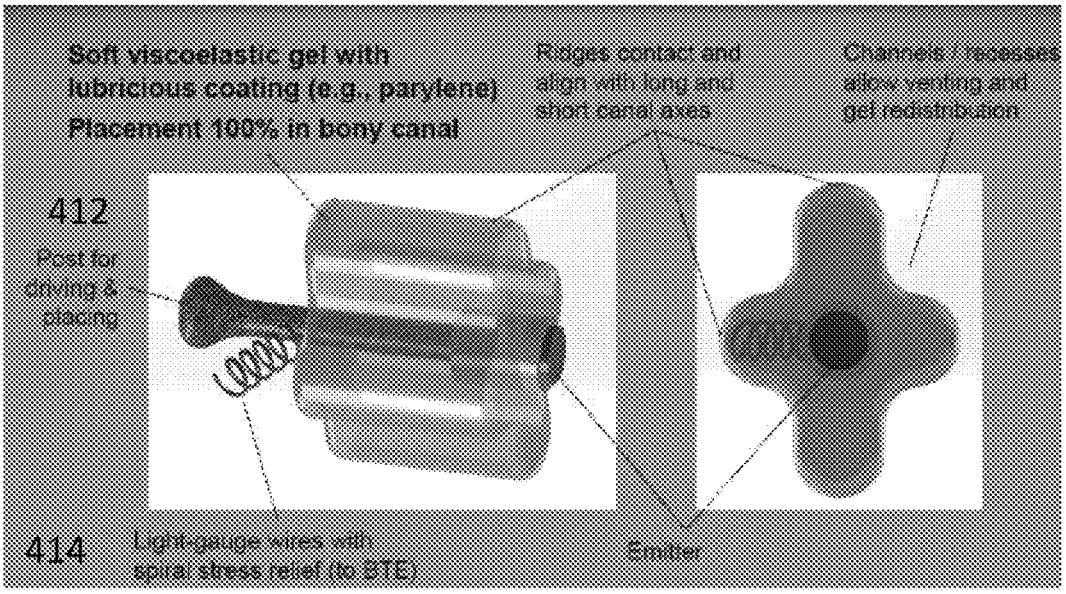
FIG. 12B shows a perspective view of the hybrid ear tip of FIG. 12A, according to some embodiments.
FIG. 12C shows a front view of the hybrid ear tip of FIG. 12A, according to some embodiments.

FIGS. 12A, 12B, and 12C show another example of a hybrid ear tip 450, which may be also combined and share features from the embodiments of the ear tips 100 and 300 described above. The ear tip 450 may comprise a hard shell 410 housed within a gel portion 420. The distal end of the hard shell 410 may comprise an output transducer 180 to be aligned with a tympanic membrane receiver 350. For example, in some embodiments the gel portion 420 may comprise a soft viscoelastic gel with a lubricous coating such as parylene. The hybrid ear tip 450 may be configured to be placed entirely within the ear canal 14. The hybrid ear tip 450 may be custom sized and shaped for an individual user. Alternatively, the hybrid ear tip 450 may be provided in a variety of sizes to fit most potential users.

The gel portion 420 may be shaped to define a plurality of channels 110 to provide venting for the ear canal 14. Similarly to the malleable element 120 described above, these channels 110 may be defined between the inner wall of the ear canal 14 and the outer surfaces of the relief or "cut-away" portions 452 of the gel portion 410. The gel portion 420 may be deformed much like the malleable structure or element 120 of the ear tip 100 described above to vary the degree of venting provided by the channels 110. The gel portion 420 may comprise a cross-shape to align with the major and minor axes of the ear canal 14. As shown in FIG. 12C, the gel portion 420 may comprise ridge portions 454 to contact the ear canal 14 along these axes. The ridge portions 454 may also define the relief or "cut-away" portions 452.

As shown in FIGS. 12B and 12C, the hard shell or core 410 provides convenience for driving/placing the tip within the ear canal and aligning it along the major canal axis. The hard core 410 may also comprise a proximal or lateral post 412 to facilitate the insertion and placement of the ear tip 450. The hard core 410 may further comprise one or more light-gauge wires 414 at the proximal or lateral portion. The wires 414 may have a spiral stress relief and may be configured to be operatively coupled with an external unit such as a BTE unit. The output transducer 180 may receive signals from the external unit through the wires 414, for example.

Figure 13A:
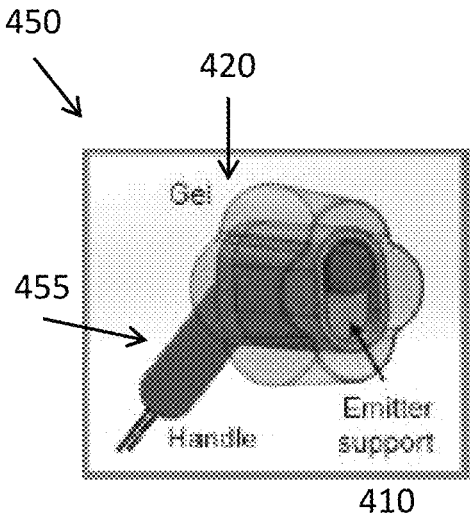
FIGS. 13A and 13B show perspective views of yet another example of an ear tip having a handle portion, according to some embodiments.
Figure 13B:
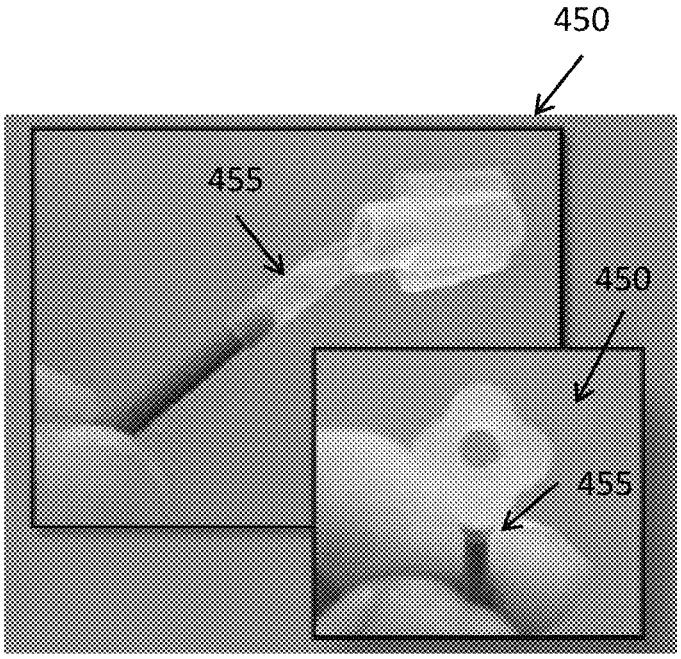

As shown in FIGS. 13A and 13B, the ear tip 450 may further comprise a handle 455 coupled to the proximal or lateral portion of the ear tip 450. The handle 455 may facilitate the insertion and placement of the ear tip 450.

Figures 14A, 14B:
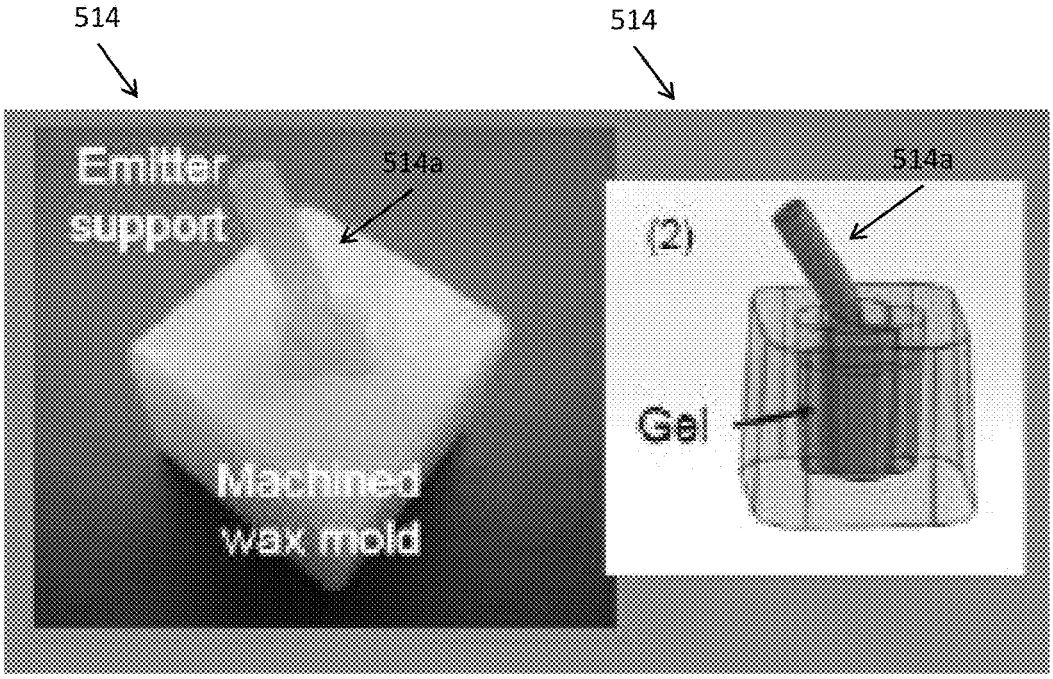
FIGS. 14A and 14B show perspective view of a wax ear tip mold, according to some embodiments.

Aspects of the present disclosure further provide methods of manufacturing or fabricating the various improved ear tips described herein. The improved ear tips may be fabricated using, for example, a sacrificial mold process. The sacrificially mold made be made in different ways such as direct machining, direct 3D printing or by casting from a rubber master which may be made by 3D printing. An exemplary sacrificial wax mold 14 is shown in FIGS. 14A and 14B. An emitter support 514*a* may be placed into the wax mold 514, and gel material may be injected into the wax mold and cured around the emitter support. The wax is then removed. The wax may be water-soluble and removed by dissolving in water. The sacrificial material may be another type of wax or plastic that can be removed by solvents and/or by heating. The wax mold 514 may be used to form the malleable element 120 or the gel portion 420 of the ear tips 100, 400, or 450 described above. The malleable element 120 or the gel portion 420 may be formed over the other components of the ear tips 100, 400, or 450, such as the wires 160, the output transducer 180, or the hard shell or core 410.

Figures 15A, 15B:
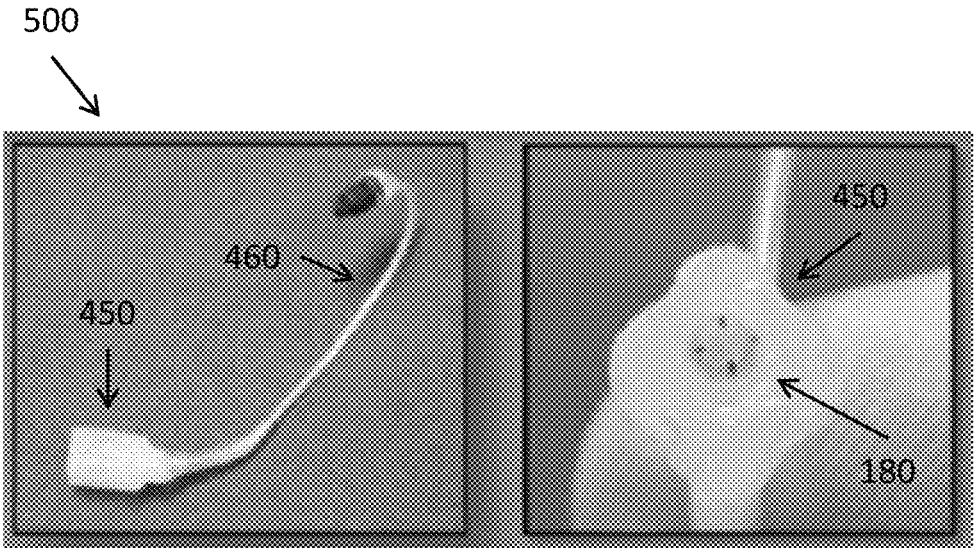
FIGS. 15A, 15B, and 15C show perspective views of an example of a complete ear tip assembly, according to some embodiments.
Figure 15C:
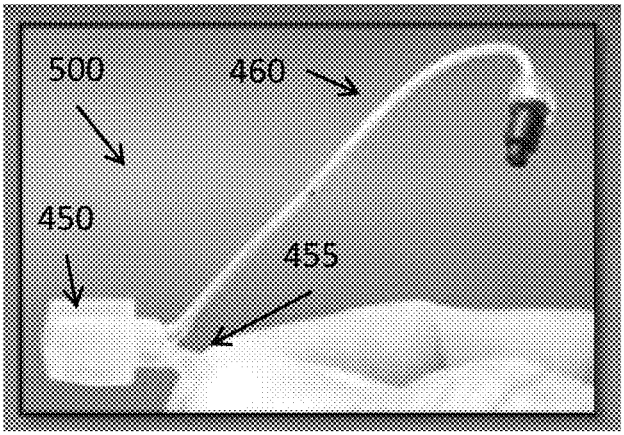

As shown in FIGS. 15A, 15B, and 15C, the ear tips, such as ear tip 450, may be provided as a component of a complete ear tip assembly 500. The inventor has fabricated and tested the complete ear tip assembly 500 shown in FIGS. 15A, 15B, and 15C. The ear tip assembly 500 may comprise the ear tip 450, the handle 455, and a cable section 460 extending proximally or laterally outward from the ear tip 450. When the ear tip 450 is placed in the ear canal, for instance, the cable section 460 may extend out of the ear canal to a "behind the ear" or BTE unit (not shown) that contains microphone, speaker, battery and electronic signal processing capability. The BTE unit may convert sound to a useful electrical signal that is delivered by cable section 460 to the output transducer 180 to generate an optical signal to a tympanic membrane receiver 350, for example.

Figure 16A:
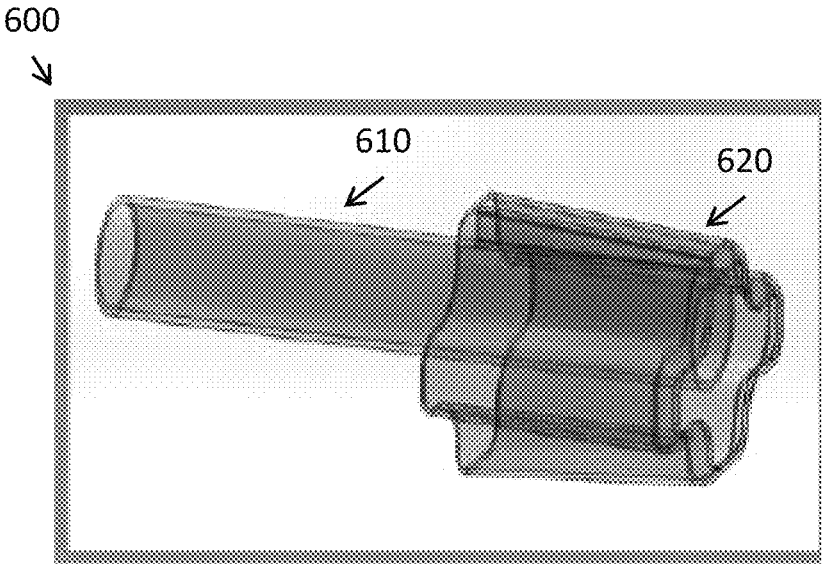
FIG. 16A shows a perspective view of a thin shell ear tip, according to some embodiments.
Figure 16B:
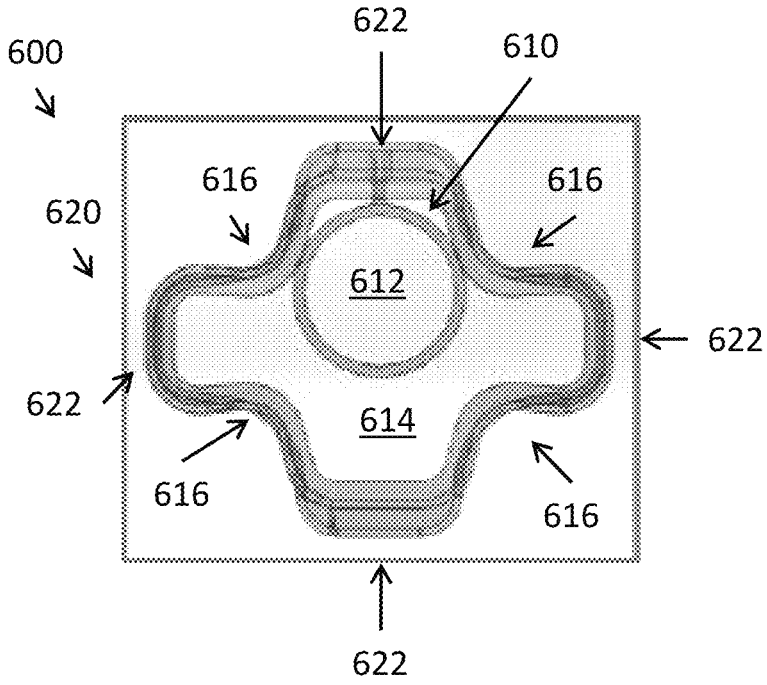
FIG. 16B shows a front view of the thin shell ear tip of FIG. 16A.

FIGS. 16A and 16B show another embodiment of the ear tips, for example, an ear tip 600 which comprises a thin shell or core. The thin shell may have a thickness of 50 to 500 μm and comprise silicone, for example. The ear tip 600 may comprise a shaft portion 610 and an ear canal contact portion 620. The thin shell may define several openings for venting the ear canal, a shaft opening 612 of the shaft portion 610, a central opening 614 defined between the shaft portion 610 and the ear canal contact portion 620, and a plurality of channels 616 to be defined between the outer surfaces of relief or cut-away portions of the ear canal contact portion 620 and the inner wall of the ear canal. The channels or folds 616 also serve to reduce radial pressure of the tip on the ear canal wall and to increase conformability of the ear tip to different ear-canal cross-section shapes. The folds 616 allow the structure to bend to reduce the radial pressure, circumventing potential generation of larger hoop stresses and pressure that could occur without folds. The ear canal contact portion 620 may be cross-shaped to be aligned with the major and minor axes of the ear canal through ear canal wall contacting extensions 622 which may define the aforementioned relief or cut-away portions disposed between adjacent extensions 622. The ear tip 600 may be fabricated by injecting material such as silicone or silicone rubber into a simple, 3-D printed mold.

Section 610 may be variable in cross section and may hold one or more wires that connect a BTE unit to a transducer 610 may also be curved to follow the shape of the ear canal. A transducer may be located in the tip 612. The leading (medial) edge of the tip may be curved to help facilitate easy insertion in the ear canal.

One or more processors may be programmed to perform various steps and methods as described in reference to various embodiments and implementations of the present disclosure. Embodiments of the systems of the present application may be comprised of various modules, for example, as discussed below. Each of the modules can comprise various sub-routines, procedures and macros. Each of the modules may be separately compiled and linked into a single executable program.

It will be apparent that the number of steps that are utilized for such methods are not limited to those described above. Also, the methods do not require that all the described steps are present. Although the methodology described above as discrete steps, one or more steps may be added, combined or even deleted, without departing from the intended functionality of the embodiments. The steps can be performed in a different order, for example. It will also be apparent that the method described above may be performed in a partially or substantially automated fashion.

As will be appreciated by those skilled in the art, the methods of the present disclosure may be embodied, at least in part, in software and carried out in a computer system or other data processing system. Therefore, in some exemplary embodiments hardware may be used in combination with software instructions to implement the present disclosure. Any process descriptions, elements or blocks in the flow diagrams described herein and/or depicted in the attached figures should be understood as potentially representing modules, segments, or portions of code which include one or more executable instructions for implementing specific logical functions or elements in the process. Further, the functions described in one or more examples may be implemented in hardware, software, firmware, or any combination of the above. If implemented in software, the functions may be transmitted or stored on as one or more instructions or code on a computer-readable medium, these instructions may be executed by a hardware-based processing unit, such as one or more processors, including general purpose microprocessors, application specific integrated circuits, field programmable logic arrays, or other logic circuitry.

While preferred embodiments have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments described herein may be employed in practicing the invention. By way of non-limiting example, it will be appreciated by those skilled in the art that particular features or characteristics described in reference to one figure or embodiment may be combined as suitable with features or characteristics described in another figure or embodiment. It is intended that the following claims define the scope of the invention and that methods and structures within the scope of these claims and their equivalents be covered thereby.

What is claimed is:

1. An ear tip apparatus for use with a hearing device, the ear tip comprising:

a malleable structure sized and configured for placement in an ear canal of a user, the malleable structure having a cross-section shaped to define at least one channel between an inner wall of the ear canal and an outer surface of the malleable structure for venting of the ear canal;

an output transducer positioned in the malleable structure, wherein the malleable structure is deformable to adjust the cross-section thereof so as to vary a size of the at least one channel to adjust a degree of venting provided by the at least one channel; and an actuator coupled to the malleable structure and operable to cause the malleable structure to deform, wherein the actuator comprises a slider configured for translation and/or rotation relative to the malleable structure.

2. The apparatus of claim 1, wherein the slider comprises one or more threads to facilitate rotation relative to the malleable structure.

3. The apparatus of claim 1, wherein translating the slider toward the malleable structure deforms the malleable structure to increase the size of the at least one channel to reduce the degree of venting provided by the at least one channel.

4. The apparatus of claim 1, wherein the actuator further comprises an elongate element coupled to the malleable structure and the slider, wherein the malleable structure is disposed over the elongate element and the slider is translatable over the elongate element.

5. The apparatus of claim 1, wherein the actuator is configured to vary the degree of venting provided by the at least one channel in response to one or more of detected feedback or an environmental cue.

6. The apparatus of claim 1, wherein the malleable structure is deformable between a low cross-sectional area configuration and a high cross-sectional area configuration, the at least one channel providing more venting when the malleable structure is in the low cross-sectional area configuration than when in the high cross-sectional area configuration.

7. The apparatus of claim 1, wherein the malleable structure has one or more of a Y-shaped, X-shaped, or cross-shaped cross-section.

8. The apparatus of claim 1, wherein the malleable structure comprises a gel.

9. The apparatus of claim 1, wherein the malleable structure comprises a fluid-filled bladder, the fluid-filled bladder comprising a bladder wall and a bladder fluid, and wherein the bladder wall comprising one or more of a stiff plastic or an elastomeric material.

* * * * *